US008516662B2

(12) United States Patent
Goodman et al.

(10) Patent No.: US 8,516,662 B2
(45) Date of Patent: Aug. 27, 2013

(54) REEL BASED LACING SYSTEM

(75) Inventors: James Paul Goodman, Valencia, CA (US); Eric Craig Irwin, Lakewood, CO (US); Mark S. Soderberg, Conifer, CO (US); Sean Cavanagh, Golden, CO (US)

(73) Assignee: Boa Technology, Inc., Denver, CO (US)

( * ) Notice: Subject to any disclaimer, the term of this patent is extended or adjusted under 35 U.S.C. 154(b) by 131 days.

(21) Appl. No.: 13/098,276

(22) Filed: Apr. 29, 2011

(65) Prior Publication Data

US 2011/0266384 A1 Nov. 3, 2011

Related U.S. Application Data

(60) Provisional application No. 61/330,129, filed on Apr. 30, 2010.

(51) Int. Cl.
*A43C 11/00* (2006.01)
*A43B 5/16* (2006.01)

(52) U.S. Cl.
USPC ..... 24/68 SK; 36/50.5

(58) Field of Classification Search
USPC ..... 24/68 SK, 70 SK, 69 SK, 71 SK, 24/909, 68 R; 36/50.1, 50.5; 74/577 SF
See application file for complete search history.

(56) References Cited

U.S. PATENT DOCUMENTS

| | | | |
|---|---|---|---|
| 59,332 | A | 10/1866 | White et al. |
| 80,834 | A | 8/1868 | Prussia |
| 117,530 | A | 8/1871 | Foote |
| 228,946 | A | 6/1880 | Schulz |
| 230,759 | A | 8/1880 | Drummond |
| 746,563 | A | 12/1903 | McMahon |
| 908,704 | A | 1/1909 | Sprinkle |
| 1,060,422 | A | 4/1913 | Bowdish |
| 1,062,511 | A | 5/1913 | Short |
| 1,090,438 | A | 3/1914 | Worth et al. |
| 1,170,472 | A | 2/1916 | Barber |
| 1,288,859 | A | 12/1918 | Feller et al. |
| 1,393,188 | A | 10/1921 | Whiteman |
| 1,469,661 | A | 2/1922 | Migita |
| 1,412,486 | A | 4/1922 | Paine |
| 1,416,203 | A | 5/1922 | Hobson |

(Continued)

FOREIGN PATENT DOCUMENTS

| | | |
|---|---|---|
| AT | 127075 | 2/1932 |
| AT | 244804 | 1/1966 |

(Continued)

OTHER PUBLICATIONS

U.S. Appl. No. 08/917,056, filed August 22, 1997, patented as U.S. Patent No. 5,934,599 on Aug. 10, 1999, including its prosecution history.

(Continued)

*Primary Examiner* — James Brittain
(74) *Attorney, Agent, or Firm* — Knobbe Martens Olson & Bear, LLP

(57) ABSTRACT

A reel based lacing system is disclosed. The reel can be configured to allow the incremental tightening of a lace about a spool by rotation of a knob in the tightening direction. In some embodiments, the system can include a substantially inflexible pawl beam configured to resist rotation of the knob in the loosening direction and a pawl spring configured to bias the pawl against the housing and to allow the pawl to be displaced away from the housing when the knob is rotated in the tightening direction.

34 Claims, 30 Drawing Sheets

(56) References Cited

U.S. PATENT DOCUMENTS

| | | | |
|---|---|---|---|
| 1,481,903 | A | 4/1923 | Hart |
| 1,530,713 | A | 2/1924 | Clark |
| 1,995,243 | A | 6/1934 | Clarke |
| 2,088,851 | A | 8/1937 | Gantenbein |
| 2,109,751 | A | 3/1938 | Matthias et al. |
| 2,124,310 | A | 9/1938 | Murr, Jr. |
| 2,316,102 | A | 4/1943 | Preston |
| 2,539,026 | A | 1/1951 | Mangold |
| 2,611,940 | A | 9/1952 | Cairns |
| 2,673,381 | A | 3/1954 | Dueker |
| 2,907,086 | A | 10/1959 | Ord |
| 2,991,523 | A | 7/1961 | Del Conte |
| 3,035,319 | A | 5/1962 | Wolff |
| 3,112,545 | A | 12/1963 | Williams |
| 3,163,900 | A | 1/1965 | Martin |
| 3,169,325 | A | 2/1965 | Fesl |
| 3,197,155 | A | 7/1965 | Chow |
| 3,221,384 | A | 12/1965 | Aufenacker |
| 3,276,090 | A | 10/1966 | Nigon |
| 3,401,437 | A | 9/1968 | Christpohersen |
| 3,430,303 | A | 3/1969 | Perrin et al. |
| 3,491,465 | A | 1/1970 | Martin |
| 3,545,106 | A | 12/1970 | Martin |
| 3,618,232 | A | 11/1971 | Shnuriwsky |
| 3,668,791 | A | 6/1972 | Salzman et al. |
| 3,678,539 | A | 7/1972 | Graup |
| 3,703,775 | A | 11/1972 | Gatti |
| 3,729,779 | A | 5/1973 | Porth |
| 3,738,027 | A | 6/1973 | Schoch |
| 3,793,749 | A | 2/1974 | Gertsch et al. |
| 3,808,644 | A | 5/1974 | Schoch |
| 3,934,346 | A | 1/1976 | Sasaki et al. |
| 3,975,838 | A | 8/1976 | Martin |
| 4,130,949 | A | 12/1978 | Seidel |
| 4,142,307 | A | 3/1979 | Martin |
| 4,227,322 | A | 10/1980 | Annovi |
| 4,261,081 | A | 4/1981 | Lott |
| 4,267,622 | A | 5/1981 | Burnett-Johnston |
| 4,408,403 | A | 10/1983 | Martin |
| 4,433,456 | A | 2/1984 | Baggio |
| 4,463,761 | A | 8/1984 | Pols et al. |
| 4,480,395 | A | 11/1984 | Schoch |
| 4,551,932 | A | 11/1985 | Schoch |
| 4,555,830 | A | 12/1985 | Petrini et al. |
| 4,574,500 | A | 3/1986 | Aldinio et al. |
| 4,616,524 | A | 10/1986 | Bidoia |
| 4,619,057 | A | 10/1986 | Sartor et al. |
| 4,620,378 | A | 11/1986 | Sartor |
| 4,631,839 | A | 12/1986 | Bonetti et al. |
| 4,631,840 | A | 12/1986 | Gamm |
| 4,633,599 | A | 1/1987 | Morell et al. |
| 4,654,985 | A | 4/1987 | Chalmers |
| 4,660,300 | A | 4/1987 | Morell et al. |
| 4,660,302 | A | 4/1987 | Arieh et al. |
| 4,680,878 | A | 7/1987 | Pozzobon et al. |
| 4,719,670 | A | 1/1988 | Kurt |
| 4,719,709 | A | 1/1988 | Vaccari |
| 4,719,710 | A | 1/1988 | Pozzobon |
| 4,722,477 | A | 2/1988 | Floyd |
| 4,741,115 | A | 5/1988 | Pozzobon |
| 4,748,726 | A | 6/1988 | Schoch |
| 4,760,653 | A | 8/1988 | Baggio |
| 4,780,969 | A | 11/1988 | White, Jr. |
| 4,787,124 | A | 11/1988 | Pozzobon et al. |
| 4,790,081 | A | 12/1988 | Benoit et al. |
| 4,796,829 | A | 1/1989 | Pozzobon et al. |
| 4,799,297 | A | 1/1989 | Baggio et al. |
| 4,802,291 | A | 2/1989 | Sartor |
| 4,811,503 | A | 3/1989 | Iwama |
| 4,826,098 | A | 5/1989 | Pozzobon et al. |
| 4,841,649 | A | 6/1989 | Baggio et al. |
| 4,856,207 | A | 8/1989 | Datson |
| 4,870,723 | A | 10/1989 | Pozzobon et al. |
| 4,870,761 | A | 10/1989 | Tracy |
| 4,884,760 | A | 12/1989 | Baggio et al. |
| 4,937,953 | A | 7/1990 | Walkhoff |
| 4,961,544 | A | 10/1990 | Bidoia |
| 5,001,817 | A | 3/1991 | De Bortoli et al. |
| 5,016,327 | A | 5/1991 | Klausner |
| 5,042,177 | A | 8/1991 | Schoch |
| 5,062,225 | A | 11/1991 | Gorza |
| 5,065,480 | A | 11/1991 | De Bortoli |
| 5,065,481 | A | 11/1991 | Walkhoff |
| 5,117,567 | A | 6/1992 | Berger |
| 5,152,038 | A | 10/1992 | Schoch |
| 5,157,813 | A | 10/1992 | Carroll |
| 5,158,428 | A | 10/1992 | Gessner et al. |
| 5,177,882 | A | 1/1993 | Berger |
| 5,181,331 | A | 1/1993 | Berger |
| 5,184,378 | A | 2/1993 | Batra |
| D333,552 | S | 3/1993 | Berger et al. |
| 5,249,377 | A | 10/1993 | Walkhoff |
| 5,259,094 | A | 11/1993 | Zepeda |
| 5,315,741 | A | 5/1994 | Debberke |
| 5,319,868 | A | 6/1994 | Hallenbeck |
| 5,325,613 | A | 7/1994 | Sussmann |
| 5,327,662 | A | 7/1994 | Hallenbeck |
| 5,335,401 | A | 8/1994 | Hanson |
| 5,341,583 | A | 8/1994 | Hallenbeck |
| 5,345,697 | A | 9/1994 | Quellais |
| 5,355,596 | A | 10/1994 | Sussmann |
| 5,357,654 | A | 10/1994 | Hsing-Chi |
| 5,381,609 | A | 1/1995 | Hieblinger |
| 5,425,161 | A | 6/1995 | Schoch |
| 5,425,185 | A | 6/1995 | Gansler |
| 5,430,960 | A | 7/1995 | Richardson |
| 5,433,648 | A | 7/1995 | Frydman |
| 5,463,822 | A | 11/1995 | Miller |
| 5,477,593 | A | 12/1995 | Leick |
| 5,502,902 | A | 4/1996 | Sussmann |
| 5,511,325 | A | 4/1996 | Hieblinger |
| 5,535,531 | A | 7/1996 | Karabed et al. |
| 5,537,763 | A | 7/1996 | Donnadieu et al. |
| 5,557,864 | A | 9/1996 | Marks |
| 5,566,474 | A | 10/1996 | Leick et al. |
| 5,596,820 | A | 1/1997 | Edauw et al. |
| 5,599,000 | A | 2/1997 | Bennett |
| 5,599,288 | A | 2/1997 | Shirley et al. |
| 5,600,874 | A | 2/1997 | Jungkind |
| 5,606,778 | A | 3/1997 | Jungkind |
| D379,113 | S | 5/1997 | McDonald et al. |
| 5,638,588 | A | 6/1997 | Jungkind |
| 5,640,785 | A | 6/1997 | Egelja |
| 5,647,104 | A | 7/1997 | James |
| 5,651,198 | A | 7/1997 | Sussmann |
| 5,669,116 | A | 9/1997 | Jungkind |
| 5,718,021 | A | 2/1998 | Tatum |
| 5,718,065 | A | 2/1998 | Locker |
| 5,732,483 | A | 3/1998 | Cagliari |
| 5,736,696 | A | 4/1998 | Del Rosso |
| 5,737,854 | A | 4/1998 | Sussmann |
| 5,755,044 | A | 5/1998 | Veylupek |
| 5,761,777 | A | 6/1998 | Leick |
| 5,784,809 | A | 7/1998 | McDonald |
| 5,819,378 | A | 10/1998 | Doyle |
| 5,833,640 | A | 11/1998 | Vazquez, Jr. et al. |
| 5,934,599 | A | 8/1999 | Hammerslag |
| 5,956,823 | A | 9/1999 | Borel |
| 6,038,791 | A | 3/2000 | Cornelius et al. |
| 6,052,921 | A | 4/2000 | Oreck |
| 6,070,886 | A | 6/2000 | Cornelius et al. |
| 6,070,887 | A | 6/2000 | Cornelius et al. |
| 6,102,412 | A | 8/2000 | Staffaroni |
| D430,724 | S | 9/2000 | Matis et al. |
| 6,119,318 | A | 9/2000 | Maurer |
| 6,128,836 | A | 10/2000 | Barret |
| 6,148,489 | A | 11/2000 | Dickie et al. |
| 6,202,953 | B1 | 3/2001 | Hammerslag |
| 6,240,657 | B1 | 6/2001 | Weber et al. |
| 6,256,798 | B1 | 7/2001 | Egolf et al. |
| 6,267,390 | B1 | 7/2001 | Maravetz et al. |
| 6,289,558 | B1 | 9/2001 | Hammerslag |
| 6,416,074 | B1 | 7/2002 | Maravetz et al. |
| 6,467,195 | B2 | 10/2002 | Pierre et al. |

| | | | |
|---|---|---|---|
| 6,477,793 | B1 | 11/2002 | Pruitt et al. |
| 6,543,159 | B1 | 4/2003 | Carpenter et al. |
| 6,568,103 | B2 | 5/2003 | Durocher |
| 6,708,376 | B1 | 3/2004 | Landry |
| 6,711,787 | B2 | 3/2004 | Jungkind et al. |
| 6,757,991 | B2 | 7/2004 | Sussmann |
| 6,775,928 | B2 | 8/2004 | Grande et al. |
| 6,802,439 | B2 | 10/2004 | Azam et al. |
| 6,877,256 | B2 | 4/2005 | Martin et al. |
| 6,922,917 | B2 | 8/2005 | Kerns et al. |
| 6,938,913 | B2 | 9/2005 | Elkington |
| 6,945,543 | B2 | 9/2005 | De Bortoli et al. |
| 6,976,972 | B2 | 12/2005 | Bradshaw |
| 6,993,859 | B2 | 2/2006 | Martin et al. |
| D521,226 | S | 5/2006 | Douglas et al. |
| 7,076,843 | B2 | 7/2006 | Sakabayashi |
| 7,082,701 | B2 | 8/2006 | Dalgaard et al. |
| 7,134,224 | B2 | 11/2006 | Elkington et al. |
| 7,281,341 | B2 | 10/2007 | Reagan et al. |
| 7,293,373 | B2 | 11/2007 | Reagan et al. |
| 7,331,126 | B2 | 2/2008 | Johnson |
| 7,367,522 | B2 | 5/2008 | Chen |
| 7,386,947 | B2 | 6/2008 | Martin et al. |
| 7,490,458 | B2 | 2/2009 | Ford |
| 7,584,528 | B2 | 9/2009 | Hu |
| 7,591,050 | B2 | 9/2009 | Hammerslag |
| 7,597,675 | B2 | 10/2009 | Ingimundarson et al. |
| 7,600,660 | B2 | 10/2009 | Kasper et al. |
| 7,617,573 | B2 | 11/2009 | Chen |
| 7,648,404 | B1 | 1/2010 | Martin |
| 7,694,354 | B2 | 4/2010 | Philpott et al. |
| 7,871,334 | B2 | 1/2011 | Young et al. |
| 7,877,845 | B2 | 2/2011 | Signori |
| 7,908,769 | B2 | 3/2011 | Pellegrini |
| 7,950,112 | B2 | 5/2011 | Hammerslag et al. |
| 7,954,204 | B2 | 6/2011 | Hammerslag et al. |
| 7,963,049 | B2 | 6/2011 | Messmer |
| 7,992,261 | B2 | 8/2011 | Hammerslag et al. |
| D646,790 | S | 10/2011 | Castillo et al. |
| 8,056,150 | B2 | 11/2011 | Stokes et al. |
| 8,074,379 | B2 | 12/2011 | Robinson, Jr. et al. |
| 8,109,015 | B2 | 2/2012 | Signori |
| 7,591,050 | C1 | 4/2012 | Hammerslag |
| D663,850 | S | 7/2012 | Joseph |
| D663,851 | S | 7/2012 | Joseph |
| D665,088 | S | 8/2012 | Joseph |
| 8,245,371 | B2 | 8/2012 | Chen |
| 8,277,401 | B2 | 10/2012 | Hammerslag et al. |
| 8,303,527 | B2 | 11/2012 | Joseph |
| 8,308,098 | B2 | 11/2012 | Chen |
| 8,381,362 | B2 | 2/2013 | Hammerslag et al. |
| 2002/0095750 | A1 | 7/2002 | Hammerslag |
| 2002/0178548 | A1 | 12/2002 | Freed |
| 2003/0177662 | A1 | 9/2003 | Elkington et al. |
| 2005/0081403 | A1 | 4/2005 | Mathieu |
| 2005/0087115 | A1 | 4/2005 | Martin |
| 2005/0098673 | A1 | 5/2005 | Huang |
| 2005/0102861 | A1 | 5/2005 | Martin |
| 2005/0198866 | A1 | 9/2005 | Wiper et al. |
| 2006/0156517 | A1 | 7/2006 | Hammerslag |
| 2006/0179685 | A1 | 8/2006 | Borel et al. |
| 2007/0113524 | A1 | 5/2007 | Lander |
| 2007/0128959 | A1 | 6/2007 | Cooke |
| 2007/0169378 | A1 | 7/2007 | Sodeberg |
| 2008/0016717 | A1 | 1/2008 | Ruban |
| 2008/0060167 | A1 | 3/2008 | Hammerslag |
| 2008/0060168 | A1 | 3/2008 | Hammerslag |
| 2008/0066272 | A1 | 3/2008 | Hammerslag |
| 2009/0172928 | A1 | 7/2009 | Messmer et al. |
| 2009/0184189 | A1 | 7/2009 | Soderberg |
| 2010/0101061 | A1 | 4/2010 | Ha |
| 2010/0139057 | A1 | 6/2010 | Soderberg |
| 2010/0154254 | A1 | 6/2010 | Fletcher |
| 2010/0175163 | A1 | 7/2010 | Litke |
| 2010/0299959 | A1 | 12/2010 | Hammerslag |
| 2010/0319216 | A1 | 12/2010 | Grenzke et al. |
| 2011/0000173 | A1 | 1/2011 | Lander |
| 2011/0071647 | A1 | 3/2011 | Mahon |
| 2011/0167543 | A1 | 7/2011 | Kovacevich et al. |
| 2011/0197362 | A1 | 8/2011 | Chella et al. |
| 2011/0225843 | A1 | 9/2011 | Kerns et al. |
| 2011/0258876 | A1 | 10/2011 | Baker et al. |
| 2012/0000091 | A1 | 1/2012 | Cotterman et al. |
| 2012/0004587 | A1 | 1/2012 | Nickel et al. |
| 2012/0005995 | A1 | 1/2012 | Emery |
| 2012/0101417 | A1 | 4/2012 | Joseph |
| 2012/0102783 | A1 | 5/2012 | Swigart et al. |
| 2012/0157902 | A1 | 6/2012 | Castillo et al. |
| 2012/0246974 | A1 | 10/2012 | Hammerslag et al. |
| 2013/0012856 | A1 | 1/2013 | Hammerslag et al. |

FOREIGN PATENT DOCUMENTS

| | | | |
|---|---|---|---|
| CA | 2112789 | | 8/1994 |
| CA | 2114387 | | 8/1994 |
| CH | 41765 | | 9/1907 |
| CH | 111341 | | 11/1925 |
| CH | 199766 | | 11/1938 |
| CH | 204 834 | A | 8/1939 |
| DE | 555211 | | 7/1932 |
| DE | 641976 | | 2/1937 |
| DE | 1 661 668 | | 8/1953 |
| DE | 7043154.8 | | 3/1971 |
| DE | 7045778.2 | | 3/1971 |
| DE | 1 785 220 | | 5/1971 |
| DE | 2 062 795 | | 6/1972 |
| DE | 7047038 | | 1/1974 |
| DE | 23 41 658 | | 3/1974 |
| DE | 24 14 439 | | 10/1975 |
| DE | 29 00 077 | A1 | 7/1980 |
| DE | 29 14 280 | A1 | 10/1980 |
| DE | 31 01 952 | A1 | 9/1982 |
| DE | 81 01 488.0 | | 7/1984 |
| DE | 38 13 470 | A1 | 11/1989 |
| DE | 3822113 | C2 | 1/1990 |
| DE | 43 02 401 | A1 | 8/1994 |
| DE | 94 13 147 | U | 10/1994 |
| DE | 93 15 776.2 | | 2/1995 |
| DE | 295 03 552.8 | | 4/1995 |
| DE | 196 24 553 | A1 | 1/1998 |
| DE | 19945045 | A1 | 9/1999 |
| DE | 201 16 755 | U1 | 1/2002 |
| EP | 0 589 232 | A1 | 3/1994 |
| EP | 0 589 233 | A1 | 3/1994 |
| EP | 0 614 624 | | 9/1994 |
| EP | 0 614 625 | A1 | 9/1994 |
| EP | 0 651 954 | A1 | 5/1995 |
| EP | 0 693 260 | B1 | 1/1996 |
| EP | 0 734 662 | A1 | 10/1996 |
| EP | 1 236 412 | A | 9/2002 |
| FR | 1 349 832 | | 1/1964 |
| FR | 1 374 110 | | 10/1964 |
| FR | 1 404 799 | | 7/1965 |
| FR | 2 019 991 | A | 7/1970 |
| FR | 2 108 428 | | 5/1972 |
| FR | 2 173 451 | | 10/1973 |
| FR | 2 175 684 | | 10/1973 |
| FR | 2 399 811 | | 3/1979 |
| FR | 2 565 795 | A1 | 12/1985 |
| FR | 2 598 292 | A1 | 11/1987 |
| FR | 2 770 379 | A1 | 5/1999 |
| FR | 2 814 919 | A1 | 4/2002 |
| GB | 11673 | | 0/1899 |
| GB | 216400 | | 5/1924 |
| GB | 2 449 722 | A | 5/2007 |
| IT | 1220811 | | 3/1998 |
| IT | PD 2003 A 000197 | | 3/2005 |
| IT | PD 2003 A 000198 | | 3/2005 |
| JP | 8-9202 | | 6/1933 |
| JP | 49-28618 | | 3/1974 |
| JP | 51-2776 | | 1/1976 |
| JP | 51-121375 | | 10/1976 |
| JP | 51-131978 | | 10/1976 |
| JP | 53-124987 | | 3/1977 |
| JP | 54-108125 | | 1/1978 |
| JP | 62-57346 | | 4/1987 |
| JP | 63-80736 | | 5/1988 |
| JP | 3030988 | | 3/1991 |
| JP | 3031760 | | 3/1991 |

| | | | |
|---|---|---|---|
| JP | 7-208 | | 1/1995 |
| JP | 10-199366 | | 7/1998 |
| JP | 2004-016732 | | 1/2004 |
| JP | 2004-041666 | | 2/2004 |
| KR | 20-0367882 | | 11/2004 |
| KR | 20-0400568 | | 11/2005 |
| KR | 10-0598627 | | 7/2006 |
| KR | 10-0953398 | | 4/2010 |
| KR | 10-1028468 | | 4/2011 |
| WO | WO 94/27456 | | 12/1994 |
| WO | WO 95/03720 | | 2/1995 |
| WO | WO 98/37782 | | 9/1998 |
| WO | WO 99/15043 | A1 | 4/1999 |
| WO | WO 00/53045 | | 9/2000 |
| WO | WO 00/76337 | A1 | 12/2000 |
| WO | WO 01/08525 | A1 | 2/2001 |
| WO | WO 2007/016983 | A1 | 2/2007 |

OTHER PUBLICATIONS

U.S. Appl. No. 09/337,763, filed Jun. 22, 1999, patented as U.S. Patent No. 6,202,953 on Mar. 20, 2001, including its prosecution history.

U.S. Appl. No. 09/388,756, filed Sep. 2, 1999, patented as U.S. Patent No. 6,289,558 on Sep. 18, 2001, including its prosecution history.

U.S. Appl. No. 09/993,296, filed Nov. 14, 2001, published as U.S. 2002-0095750 on July 25, 2002, including its prosecution history.

U.S. Appl. No. 10/459,843, filed Jun. 12, 2003, published as U.S. 2003-0204938 on Nov. 6, 2003, patented as U.S. Patent No. 7,591,050 on Sep. 22, 2009, including its prosecution history.

U.S. Appl. No. 11/263,253, filed Oct. 31, 2005, published as U.S. 2006-0156517 on Jul. 20, 2006, including its prosecution history.

U.S. Appl. No. 11/650,665, filed Jan. 8, 2007, published as U.S. 2007-0169378 on Jul. 26, 2007, including its prosecution history.

U.S. Appl. No. 11/841,872, filed Aug. 20, 2007, published as U.S. 2008-0060167 on Mar. 13, 2008, including its prosecution history.

U.S. Appl. No. 11/841,997, filed Aug. 20, 2007, published as U.S. 2008-0066345 on Mar. 20, 2008, patented as U.S. Patent No. 7,992,261 on Aug. 9, 2011, including its prosecution history.

U.S. Appl. No. 11/842,005, filed Aug. 20, 2007, published as U.S. 2008-0083135 on Apr. 10, 2008, patented as U.S. Patent No. 7,950,112 on May 31, 2011, including its prosecution history.

U.S. Appl. No. 11/842,009, filed Aug. 20, 2007, published as U.S. 2008-0060168 on Mar. 13, 2008, including its prosecution history.

U.S. Appl. No. 11/842,013, filed Aug. 20, 2007, published as U.S. 2008-0066346 on Mar. 20, 2008, patented as U.S. Patent No. 7,954,204 on Jun. 7, 2011, including its prosecution history.

U.S. Appl. No. 11/854,522, filed Sep. 12, 2007, published as U.S. 2008-0066272 on Mar. 20, 2008, including its ongoing prosecution history.

U.S. Appl. No. 12/355,675, filed Jan. 16, 2009, published as U.S. 2009-0184189 on Jul. 23, 2009, including its ongoing prosecution history.

U.S. Appl. No. 12/623,362, filed Nov. 20, 2009, published as U.S. 2010-0139057 on Jun. 10, 2010, including its ongoing prosecution history.

U.S. Appl. No. 11/070,579, filed Mar. 1, 2005, published as U.S. 2005-0198866 on Sep. 15, 2005, including its prosecution history.

U.S. Appl. No. 09/956,901, filed Sep. 18, 2001, including its prosecution history, Gary R. Hammerslag.

Re-Examination of U.S. Patent No. 7,591,050, Re-Exam Control 90/011,028, including its ongoing prosecution history, filed Jun. 11, 2010, Gary R. Hammerslag.

U.S. Appl. No. 12/853,141, filed Aug. 9, 2010, published as U.S. 2010-0299959 on Dec. 2, 2010, including its ongoing prosecution history.

U.S. Appl. No. 13/011,707, filed Jan. 21, 2011, including its ongoing prosecution history, Mark Kerns et al.

U.S. Appl. No. 13/174,527, filed Jun. 30, 2011, including its ongoing prosecution history, Jesse D. Cotterman, et al.

U.S. Appl. No. 13/174,533, filed Jun. 30, 2011, including its ongoing prosecution history, Michael J. Nickel, et al.

U.S. Appl. No. 13/273,060 including its prosecution history, filed Oct. 13, 2011, Soderberg, et al.

U.S. Appl. No. 13/793,919 including its prosecution history, filed Mar. 11, 2013, Cotterman, et al.

International Search Report and Written Opinion in PCT/US2011/034692 dated Feb. 27, 2012 in 9 pages.

International Preliminary Report on Patentability in PCT/US2011/034692 dated Nov. 15, 2012 in 6 pages.

ASOLO® Boot Brochure Catalog upon information and belief date is as early as Aug. 22, 1997.

REEL BASED LACING SYSTEM

CROSS-REFERENCE TO RELATED APPLICATIONS

This application claims priority under 35 U.S.C. §119(e) to U.S. Provisional Patent Application No. 61/330,129, filed Apr. 30, 2010, and titled REEL BASED LACING SYSTEM, the entirety of which is hereby incorporated by reference.

BACKGROUND OF THE INVENTION

1. Field of the Invention

Embodiment disclosed herein relate to lacing or closure systems and their related components used alone or in combination in any variety of articles including footwear, closeable bags, protective gear, etc.

2. Description of the Related Art

There exist a number of mechanisms and methods for tightening articles such as footwear. Nevertheless, there remains a need for improved devices and methods.

SUMMARY OF THE INVENTION

In some embodiments, a reel for use in a lacing system is disclosed. The reel can include a housing having a plurality of housing teeth. The reel can include a spool supported by the housing, and the spool can be rotatable with respect to the housing. The spool can include a channel formed therein, and the channel can be configured to collect a lace therein to tighten the lacing system as the spool is rotated in a tightening direction. The channel can release lace therefrom to loosen the lacing system as the spool is rotated in a loosening direction. The reel can include a knob supported by the housing, and the knob can be rotatable with respect to the housing. The knob can be coupled to the spool such that rotation of the knob causes the spool to also rotate. The knob can include one or more pawls, and at least one of the one or more pawls can include a pawl beam and a pawl spring. The pawl beam can be movable between a first position and a second position, and the pawl spring can be configured to bias the pawl beam toward the first position. The pawl beam can include one or more pawl teeth configured to engage the housing teeth when the pawl beam is in the first position to prevent the knob from rotating in the loosening direction when a loosening force is applied to the knob without transferring a substantial portion of the loosening force to the pawl spring. In some embodiments, the pawl beam and the pawl spring can be integrally formed (e.g., integrally molded). In some embodiments, the one or more pawl teeth can be displaced away from the housing teeth to the second position when the knob is twisted in the tightening direction to allow the knob and spool to rotate in the tightening direction.

In some embodiments, the housing teeth can extend in a radial direction, and the pawl beam can be radially movable between the first position and the second position, and the knob can be axially movable between an engaged position and a disengaged position. When the knob is in the disengaged position, the spool can be permitted to rotate in the loosening direction. The one or more pawls can be configured to engage the housing teeth such that, when the loosening force is applied to the knob, the knob is prevented from rotating in the loosening direction without applying substantial force to the knob in the axial direction.

In some embodiments, a pawl is disclosed, and the pawl can include at least two pawl teeth configured to simultaneously engage at least two corresponding housing teeth such that a loosening force is distributed across multiple teeth to prevent rotation in the loosening direction. In some embodiments, the pawl beam can be configured to be urged toward the housing teeth when a loosening force is applied to the knob. A loosening force can be applied to the knob by a user twisting the knob in the loosening direction or by tension on the lace coupled to the spool. The pawl beam can be configured to rotate radially about a pivot axis, and one or more of the pawl teeth can engage the housing teeth at a location that is radially outward from a tangent line extending from the pivot axis. The pawl teeth can have a surface configured to press against a surface of the housing teeth when a loosening force is applied to the knob such that the pawl beam is urged towards the housing teeth when a loosening force is applied. The pawl beam can be prevented from moving to the second position unless the knob is rotated in the tightening direction to disengage the surface of the at least one pawl tooth from the surface of the housing tooth. A side of the pawl beam can be configured to abut against one or more tips of housing teeth that are not engaged by the one or more pawl teeth when a loosening force is applied to the knob and the pawl beam is urged toward the housing teeth to provide added support.

In some embodiments, a method of making a reel for use in a lacing system is disclosed. The method can include providing a housing, and the housing can include a plurality of housing teeth. The method can include placing a spool within the housing such that the spool is rotatable with respect to the housing. The spool can include a channel formed therein, and the channel can be configured to collect a lace therein to tighten the lacing system as the spool is rotated in a tightening direction. The channel can be configured to release lace therefrom to loosen the lacing system as the spool is rotated in a loosening direction. The method can include attaching a knob to the housing such that the knob is rotatable with respect to the housing. The knob can be coupled to the spool so that rotation of the knob causes the spool to also rotate. The knob can include one or more pawls, and at least one of the one or more pawls can include a pawl beam and a pawl spring. The pawl beam can be movable between a first position and a second position and the pawl spring can be configured to bias the pawl beam toward the first position. The pawl beam can include one or more pawl teeth configured to engage the housing teeth when the pawl beam is in the first position to prevent the knob from rotating in the a loosening direction when a loosening force is applied to twist the knob in the loosening direction without transferring a substantial portion of the loosening force to the pawl spring. The one or more pawl teeth can be displaced away from the housing teeth to the second position when the knob is twisted in the tightening direction to allow the knob and spool to rotate in the tightening direction. In some embodiments, the pawl beam and the pawl spring can be integrally formed.

In some embodiments, a pawl for use with a reel in a lacing system is disclosed. The pawl can include a pawl beam having one or more pawl teeth configured to interface with housing teeth on a housing of the reel. The pawl beam can be movable between a first position and a second position. The pawl can include a pawl spring configured to bias the pawl beam toward the first position. The one or more pawl teeth can engage the housing teeth when the pawl beam is in the first position to prevent the pawl from moving in a loosening direction when a loosening force is applied to pawl without transferring a substantial portion of the loosening force to the pawl spring. The one or more pawl teeth can disengage from the housing teeth when the pawl beam is in the second position to allow the pawls to move in a tightening direction. In some embodiments, the pawl beam and the pawl spring can be integrally formed.

In some embodiments, a reel for use in a lacing system is disclosed. The reel can include a housing comprising a plurality of housing teeth, and a spool supported by the housing such that the spool is rotatable with respect to the housing. The spool can include a channel formed therein, and the channel can be configured to collect a lace therein to tighten the lacing system as the spool is rotated in a tightening direction and to release lace therefrom to loosen the lacing system as the spool is rotated in a loosening direction. The reel can include a knob supported by the housing such that the knob is rotatable with respect to the housing. The knob can be coupled to the spool such that rotation of the knob causes the spool to also rotate. The knob can include one or more pawls configured to interface with the housing teeth, and at least one of the one or more pawls can include a flexible pawl arm attached to the knob at a first end and having one or more pawl teeth formed on a second end. The pawl arm can be configured to flex in a first direction as the knob is rotated in the tightening direction such that the one or more pawl teeth are displaced away from the housing teeth to allow the knob to rotate in the tightening direction. The pawl arm can be configured such that when a loosening force is applied to twist the knob in the loosening direction, the one or more pawl teeth engage the corresponding housing teeth to prevent the knob from rotating in the loosening direction, and the loosening force causes the flexible pawl arm to flex in a second direction toward the housing teeth such that the flexible pawl arm abuts against the housing teeth to prevent the flexible pawl arm from buckling under the loosening force.

In some embodiments, a pawl is disclosed that includes a substantially rigid pawl beam and a flexible pawl spring. The pawl spring can be a flexible arm. In some embodiments, the pawl beam can be movable between a first position and a second position, and the pawl spring can be configured to bias the pawl beam toward the first position. The flexible arm can assume a less flexed position when the pawl beam is in the first position, and the flexible arm can assume a more flexed position when the pawl beam is in the second position. In some embodiments, the flexible arm can be less curved when in the more flexed position than when in the less flexed position. In some embodiments, the flexible arm can extend generally in the same direction as the pawl spring. In some embodiments, the pawl beam and the pawl spring can be integrally formed.

In some embodiments, a knob is disclosed that can be used with a reel in a lacing system. The knob can include one or more pawls. At least one of the one or more pawls can be coupled to the knob at a pivot axis. The at least one pawl can include a pawl beam configured to rotate about the pivot axis between a first position and a second position, and a pawl spring can bias the pawl beam toward the first position where the pawl beam engages housing teeth on the reel to prevent the knob from rotating in a loosening direction. In some embodiments, the pawl spring can extend from near the pivot axis in generally the same direction as the pawl beam. In some embodiments, the pawl spring can be a flexible arm. In some embodiments, the flexible arm can curve away from the pawl beam. The pawl spring can be integrally formed with the pawl beam.

In some embodiments, a reel for use in a lacing system is disclosed. The reel can include a housing having a plurality of housing teeth. The reel can include a spool supported by the housing, and the spool can be rotatable with respect to the housing. The reel can include a knob supported by the housing, and the knob can be rotatable with respect to the housing. The knob can be coupled to the spool such that rotation of the knob causes the spool to also rotate. The knob can include one or more pawls, and at least one of the one or more pawls can include a substantially rigid pawl beam and a pawl spring. The pawl beam can be movable between a first position and a second position, and the pawl spring can be configured to bias the pawl beam toward the first position. The pawl beam can include one or more pawl teeth configured to engage the housing teeth when the pawl beam is in the first position to prevent the knob from rotating in the loosening direction. In some embodiments, the one or more pawl teeth can be movable away from the housing teeth to the second position when the knob to allow the knob and spool to rotate in the tightening direction. The substantially rigid pawl beam can be configured to withstand the loosening force. The pawl beam and the pawl spring can be integrally formed in some embodiments.

BRIEF DESCRIPTION OF THE DRAWINGS

Certain embodiments of the inventions will now be discussed in detail with reference to the following figures. These figures are provided for illustrative purposes only, and the inventions are not limited to the subject matter illustrated in the figures.

DETAILED DESCRIPTION OF THE PREFERRED EMBODIMENT

Figure 1:
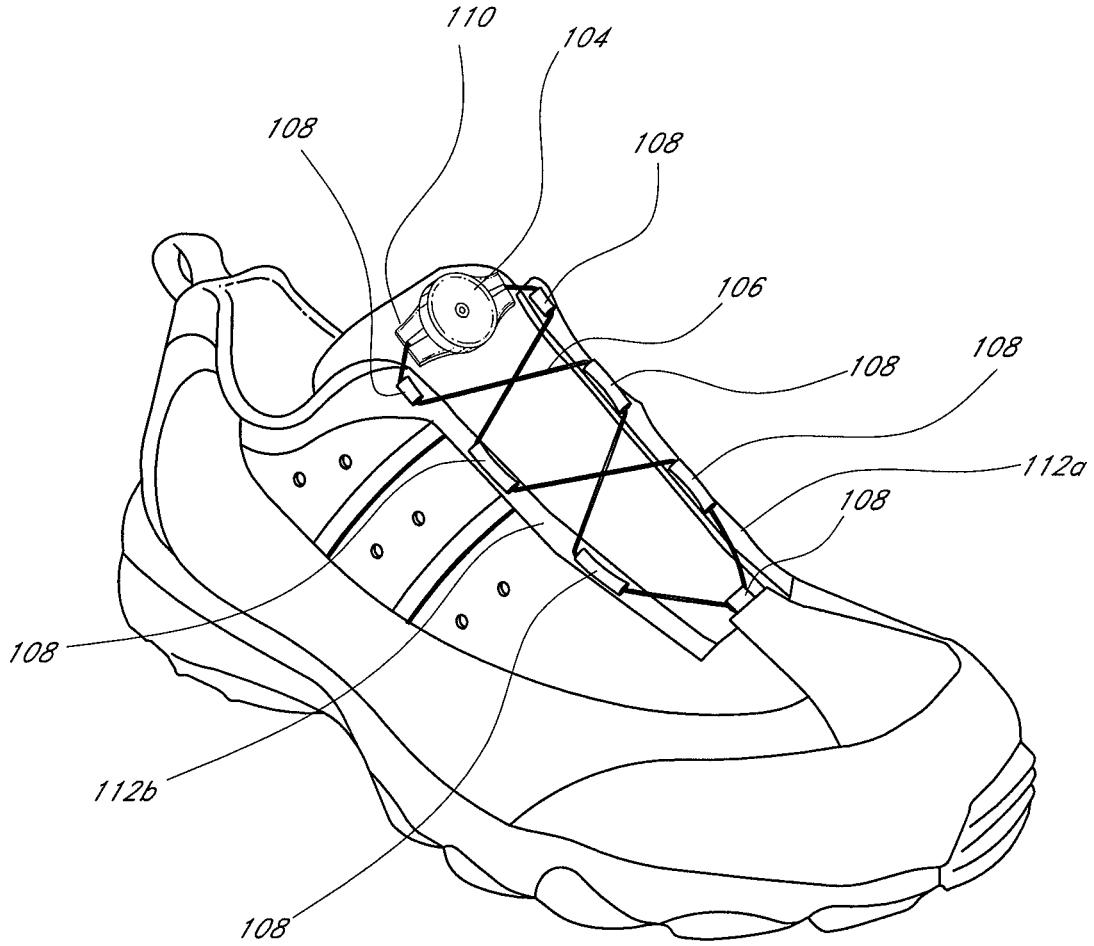
FIG. 1 is a perspective view of an embodiment of a lacing system in use with a sport shoe.

FIG. 1 is a perspective view of a lacing system 100 used for tightening a sport shoe 102. The sport shoe can be a running shoe, a basketball shoe, and ice skating boot, or snow boarding boot, or any other suitable footwear that can be tightened around a wearer's foot. The lacing system 100 can be used to close or tighten various other articles, such as, for example, a belt, a hat, a glove, snow board bindings, a medical brace, or a bag. The lacing system can include a reel 104, a lace 106, and one or more lace guides 108. In the illustrated embodiment, the reel 104 can be attached to the tongue 110 of the shoe. Various other configurations are possible. For example, the reel 104 can be attached to a side of the sport shoe 102, which can be advantageous for shoes in which the shoe sides 112*a-b* are designed to be drawn closely together when tightened leaving only a small portion of the tongue 110 exposed. The reel 104 can also be attached to the back of the shoe 102, and a portion of the lace 106 can pass through the shoe 102 on either side of the wearer's ankle such that the lace 106 can be engaged with the reel 104 when back-mounted.

Figure 2:
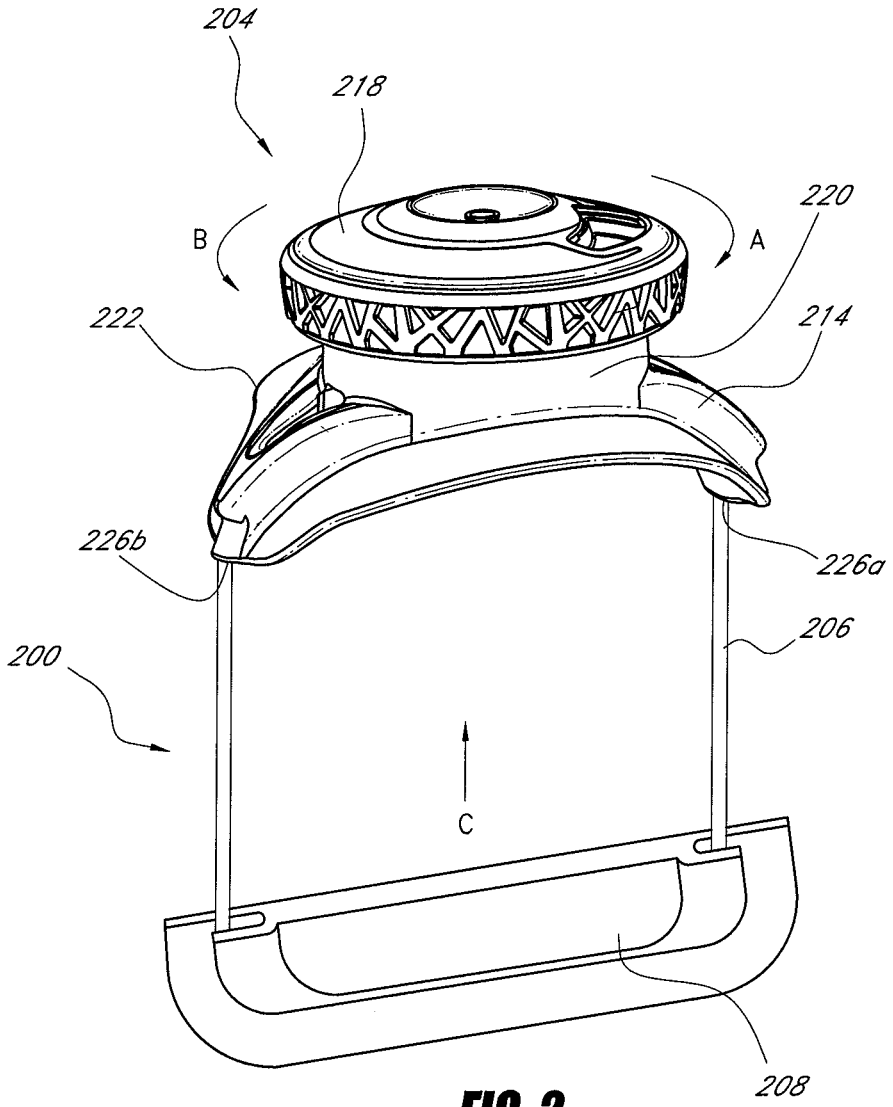
FIG. 2 is a perspective view of an embodiment of a lacing system.
Figure 3:
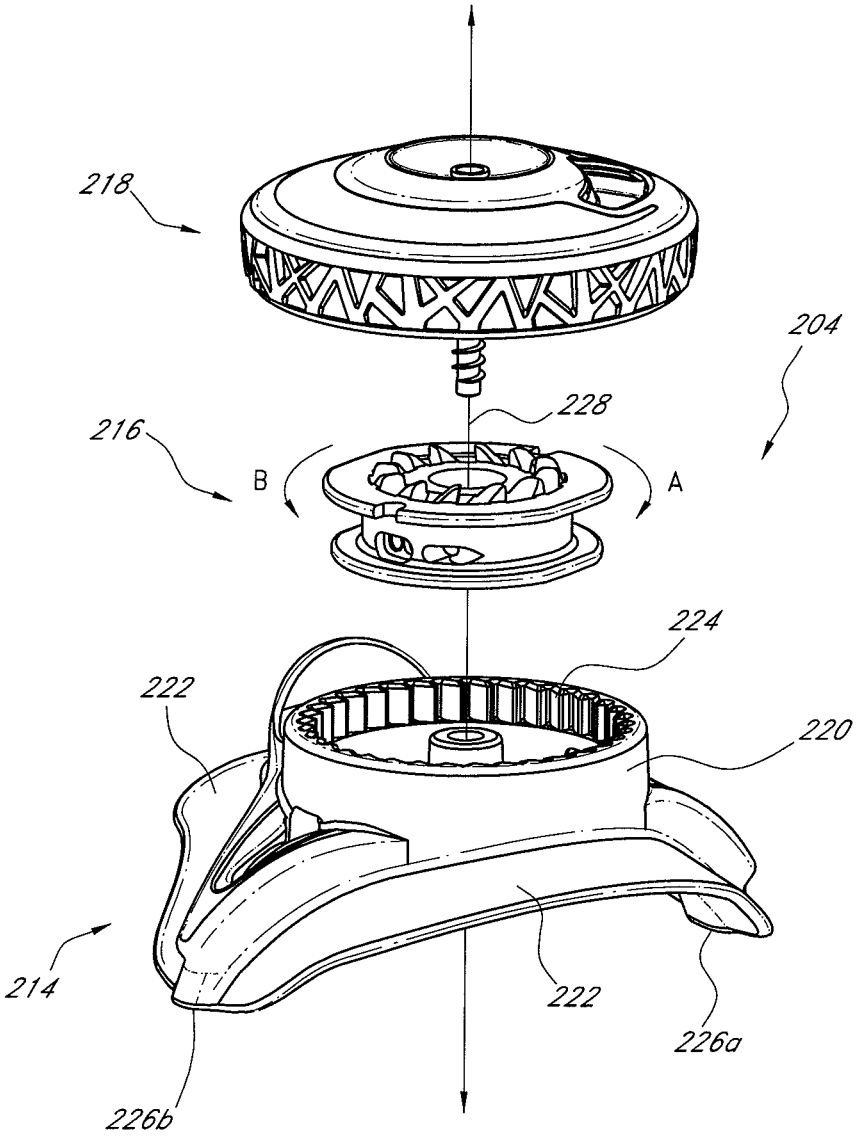
FIG. 3 is an exploded perspective view of the reel from the lacing system of FIG. 2.
Figure 4:
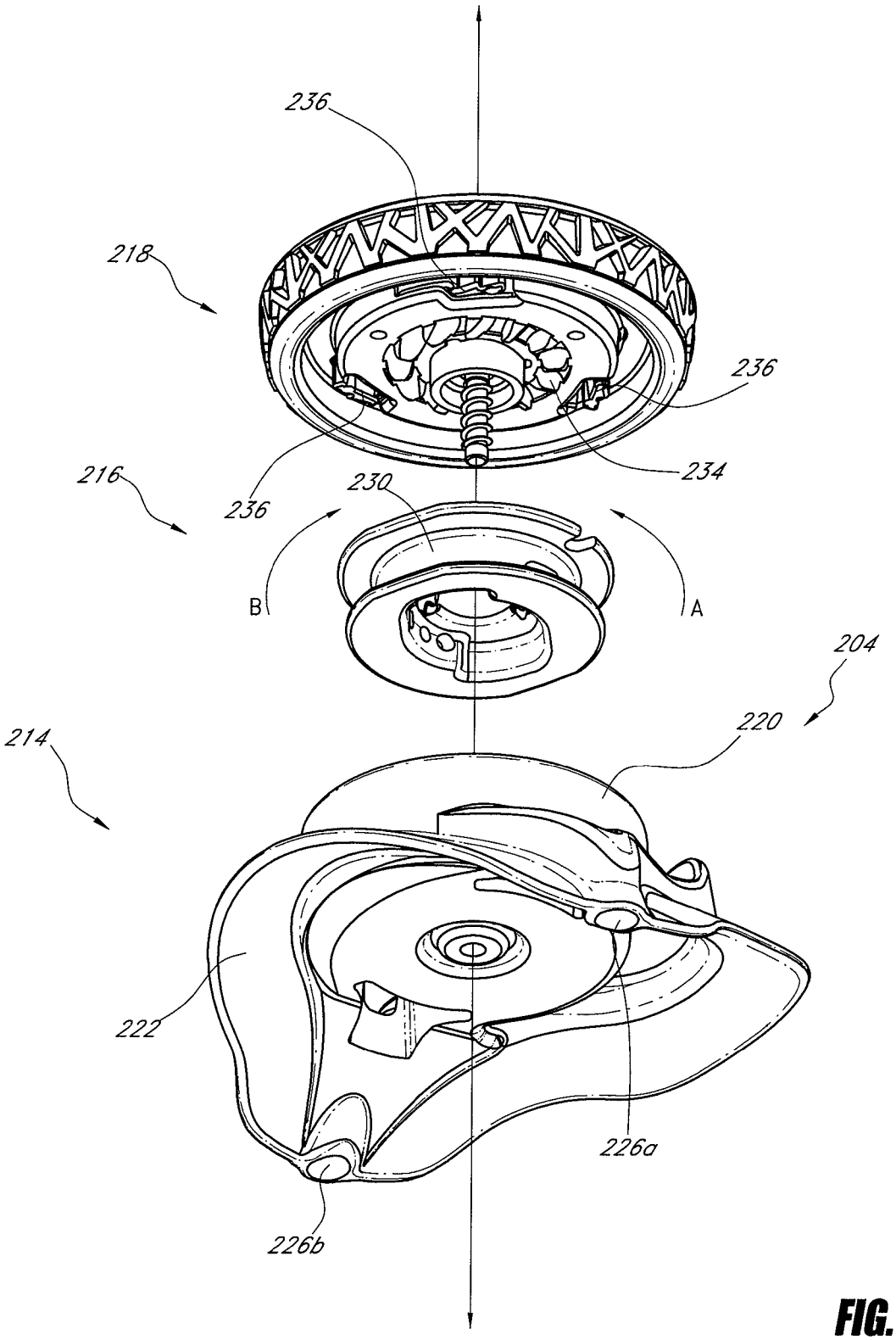
FIG. 4 is another exploded perspective view of the reel of FIG. 3.

FIG. 2 is a perspective view of a lacing system 200 that can be similar to the lacing system 100, or any other lacing system described herein. The lacing system can include a reel 204 which can be similar to the reel 104, or any other reel described herein. FIG. 3 is an exploded perspective view of the reel 204. FIG. 4 is another exploded perspective view of the reel 204.

With reference to FIGS. 2 to 4, the reel 204 can include a base member 214, a spool member 216, and a knob member 218. The base member can include a housing 220 and a mounting flange 222. The housing 220 can include a plurality of housing teeth 224, which can extend radially inwardly. The housing 220 can include lace holes 226*a-b* that allow the lace 206 to enter the housing 220.

The spool member 216 can be disposed within the housing 220 such that the spool member 216 is rotatable about an axis 228 with respect to the housing 220. The lace 206 can be secured to the spool member 216 such that when the spool member 216 rotates in a tightening direction (shown by arrow A) the lace 206 is drawn into the housing 220 and is wound around the channel 230 formed in the spool member 216, and when the spool member 216 rotates in a loosening direction (shown by arrow B) the lace 206 unwinds from the channel 230 of the spool member 216 and exits the housing 220 via the lace holes 226*a-b*. The spool member 216 can also include spool teeth 232 formed thereon. It will be understood that the embodiments disclosed herein can be modified such that rotation in the direction shown by arrow B will tighten the lacing system and such that rotation in the direction shown by arrow A will loosen the lacing system.

The knob member 218 can be attached to the housing 220 such that the knob member 218 can rotate about the axis 228 with respect to the housing 220. The knob member 218 can include knob teeth 234 that can be configured to mate with the spool teeth 232 to couple the knob member 218 to the spool member 216 such that rotation of the knob member 218 in the tightening direction causes the spool member 216 to also rotate in the tightening direction. In some embodiments, the rotation of the knob member 218 in the loosening direction can also cause the spool member 216 to rotate in the loosening direction. The knob member 218 can also include one or more pawls 236 which can be biased radially outwardly so as to mate with the housing teeth 224. The pawls 236 and housing teeth 224 can be configured so that the housing teeth 224 can displace the pawls 236 radially inwardly when the knob member 218 is rotated in the tightening direction, thereby allowing the knob member 218 to rotate in the tightening direction. The pawls 236 and the housing teeth 224 can also be configured so that they engage one another when force is applied to twist the knob member 218 in the loosening direction, thereby preventing the knob member 218 from rotating in the loosening direction.

Thus, the reel 204 can provide a one-way tightening system configured to allow the user to rotate the knob member 218 in the tightening direction, which causes the spool member 216 to rotate in the tightening direction, which in turn causes the lace 206 to be drawn into the housing 220 via the lace holes 226*a-b*. As the lace 206 is drawn into the housing 220 the lacing system 200 can tighten, causing the lace guide 208 to be drawn in the direction toward the reel 204 (shown by arrow C in FIG. 2). Although the lacing system 200 is shown with a single lace guide 208, any other suitable number of lace guides can be used.

Figure 5:
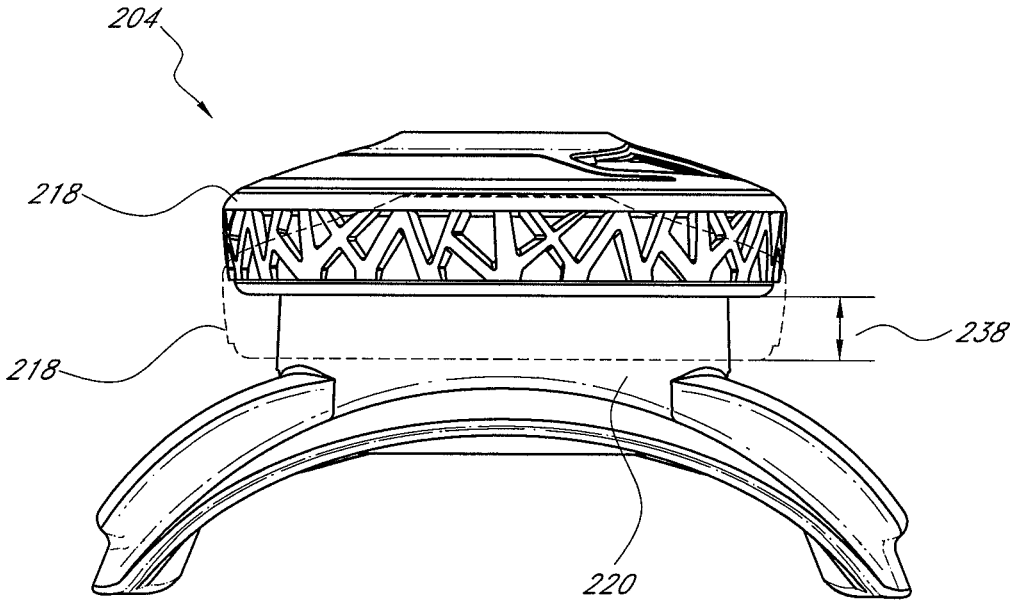
FIG. 5 is a side view of the reel of FIG. 3 with the knob member shown in a disengaged position drawn in normal lines, and with the knob member in an engaged position shown drawn in dotted lines.

In some embodiments, the knob member 218 can be axially movable along the axis 228 between a first or engaged position and a second or disengaged position. FIG. 5 is a side view of the reel 204 showing the knob member 218 in the disengaged position drawn in normal lines and showing the knob member 218 in the engaged position outlined in dotted lines. When in the engaged position, the spool teeth 232 can engage with the knob teeth 234 to couple the knob member 218 to the spool member 216 as described above. Also, when in the engaged position, the pawls 236 can engage with the housing teeth 224 to allow the knob member 218 to rotate in the tightening direction while preventing the knob member 218 from rotating in the loosening direction, as discussed above.

When in the disengaged position, the knob member 218 can be positioned axially further away from the base member 214 by a distance 238 that is sufficient to cause the knob teeth 234 to lift away from and disengage the spool teeth 232 so that the spool member 216 is decoupled from the knob member 218 and the spool member 216 is free to rotate separately from the knob member 218. Thus, the lace 206 can be withdrawn from the housing 220 as the spool member 216 rotates in the loosening direction causing the lacing system 200 to loosen. When in the disengaged position, the pawls 236 of the knob member 218 can be lifted away from the housing teeth 224 such that they disengage and the knob member 218 is free to rotate in the both the tightening and loosening direction without restriction. In some embodiments, when the knob member 218 is transitioned to the disengaged position, the knob teeth 234 disengage from the spool teeth 232 and the pawls 236 also disengage from the housing teeth 224. In some embodiments, when the knob member 218 is transitioned to the disengaged position, the knob teeth 234 disengage from the spool teeth 232 while the pawls 236 continue to engage the housing teeth 224. In some embodiments, when the knob member 218 is transitioned to the disengaged position, the knob teeth 234 continue to engage the spool teeth 232 but the pawls 236 disengage from the housing teeth 224.

The distance 238 between the engaged and disengaged positions of the knob member 318 can be at least about 1 mm and/or no more than about 3 mm, and can be about 2.25 mm in some embodiments, although distances outside these ranges can also be used. In some embodiments, the distance 238 can be approximately the same, or slightly greater than, the height of the spool teeth 232, the height of the knob teeth 234, the height of the housing teeth 224, and/or the height of the pawls 236.

In some embodiments, because the pawls 236 engage the housing teeth 224 in a radial direction while the knob member 218 is movable between the engaged and disengaged positioned in the axial direction, the reel 204 can be resistant to accidental disengagement. When the knob member is in the engaged position, and a force is applied to attempt to twist the knob member 218 in the loosening direction, or lace is pulled tightly causing the spool member 218 to attempt to twist in the loosening direction, the force is applied to the pawls 236 as they engage the housing teeth 224. Because the pawls 236 are configured to be displaced radially, not axially, substantially none of the force applied to the pawls 236 is transferred in the axial direction. Therefore, the reel 204 can resist higher tightening pressure than some reels in which knob pawls engage housing teeth in the axial direction.

Figure 6:
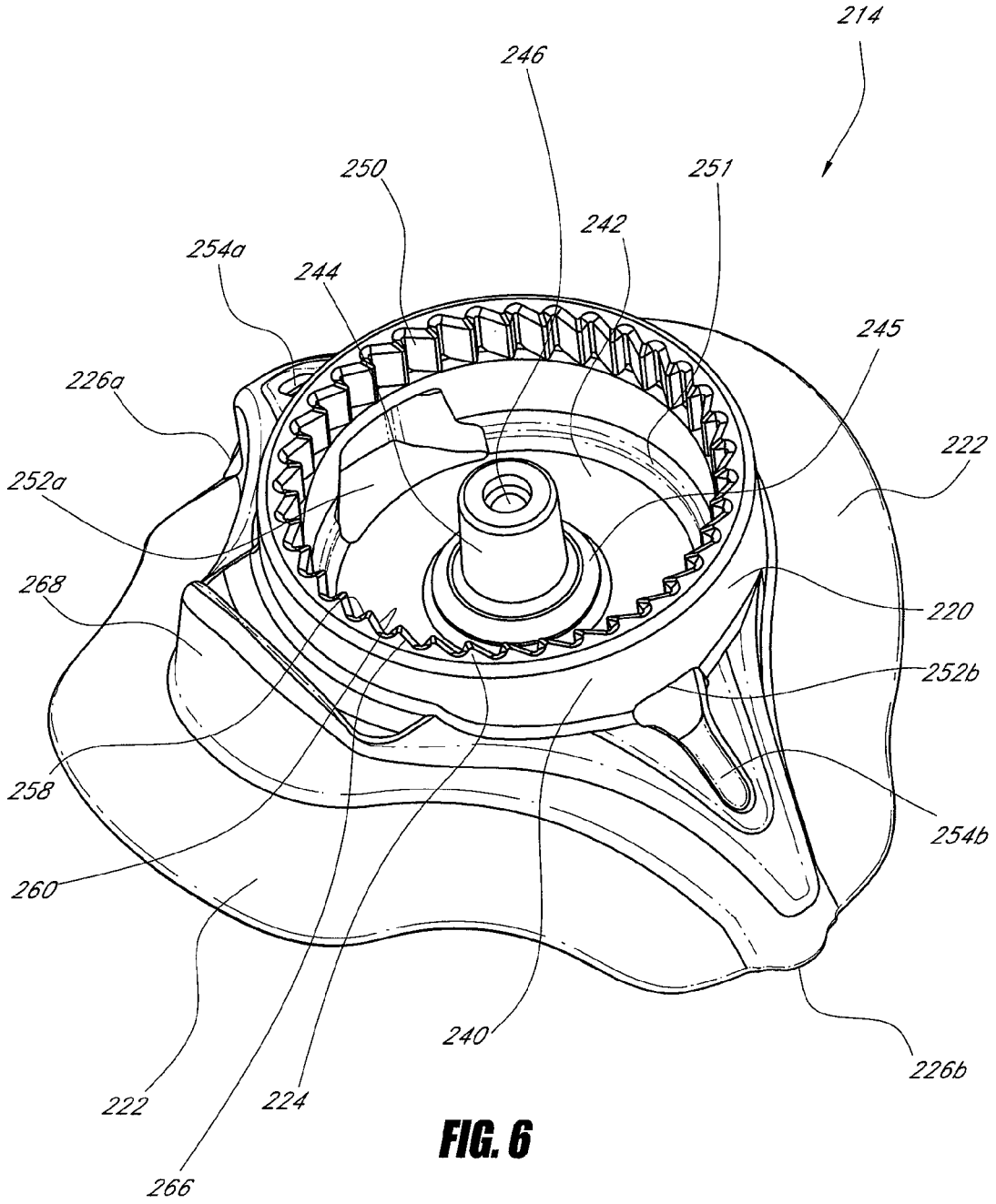
FIG. 6 is a perspective view of the base member from the reel of FIG. 3.
Figure 7:
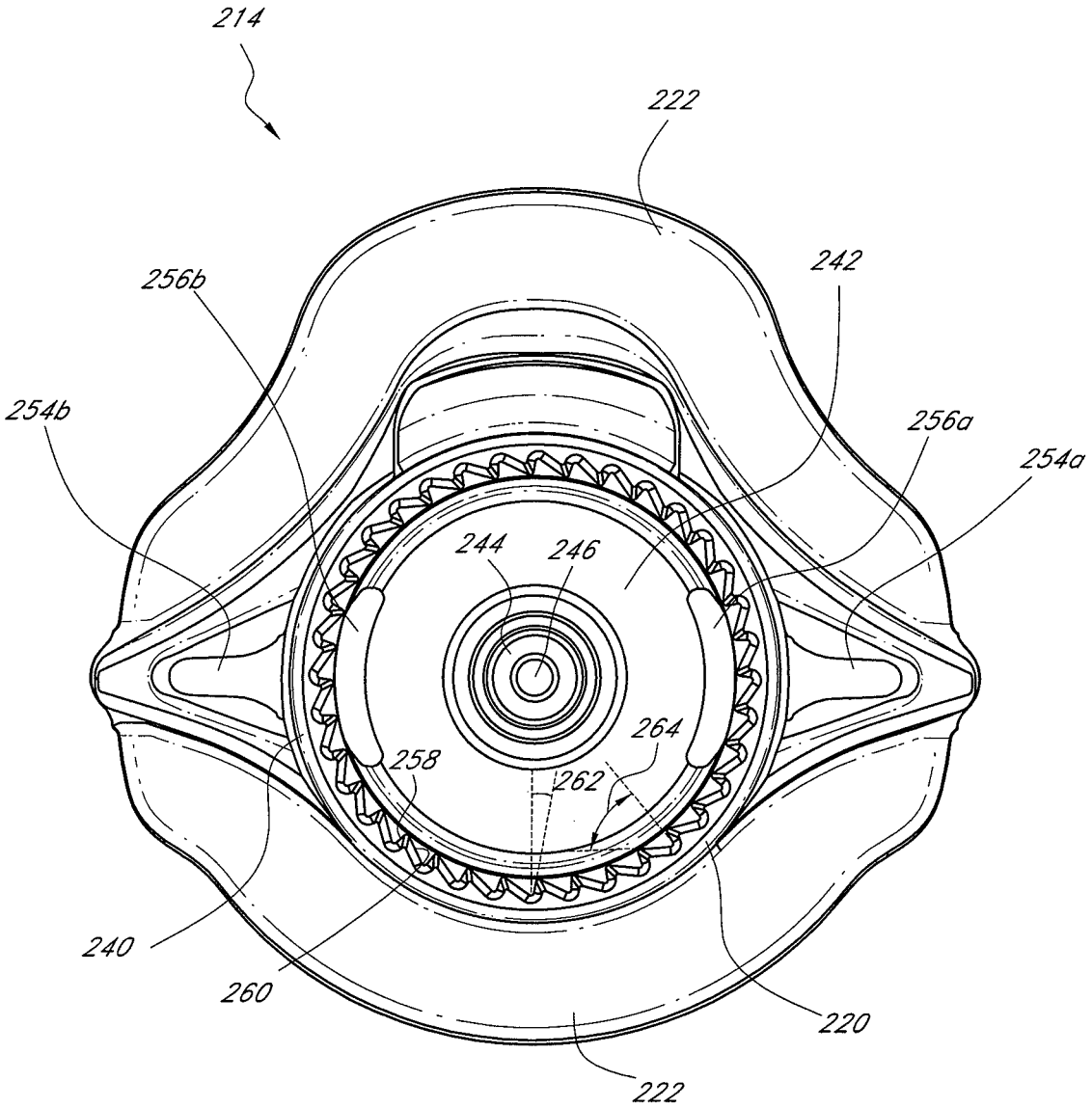
FIG. 7 is a top view of the base member of FIG. 4.
Figure 8:
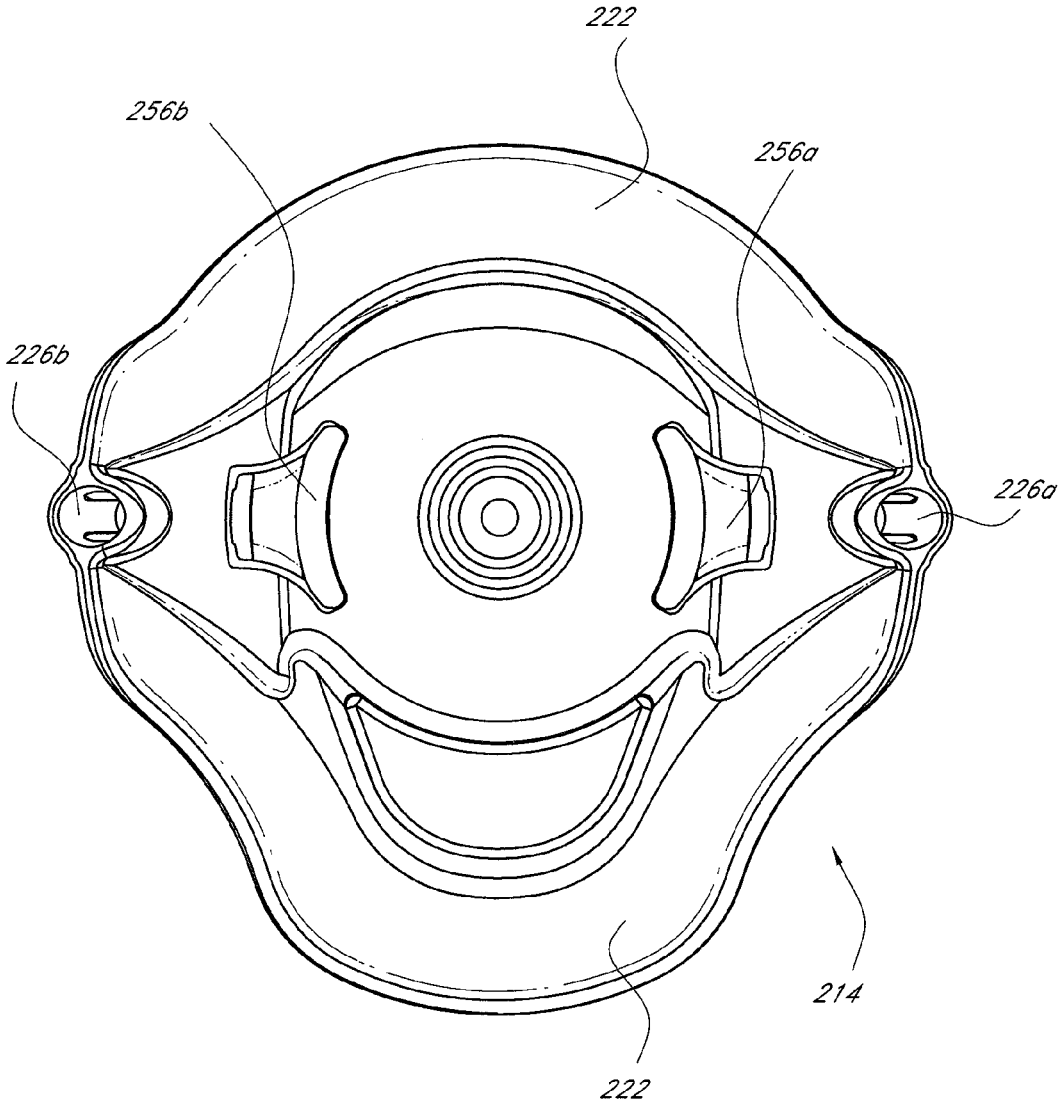
FIG. 8 is a bottom view of the base member of FIG. 4.
Figure 9:
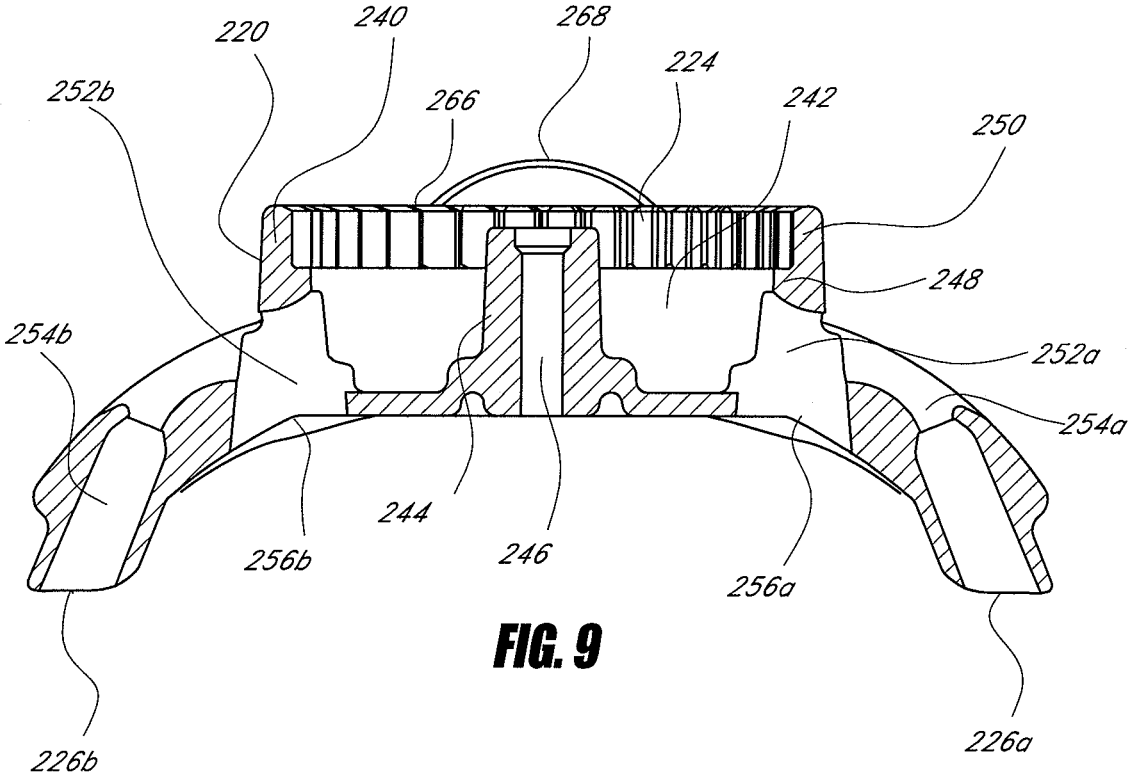
FIG. 9 is a cross sectional side view of the base member of FIG. 4.

FIG. 6 is a perspective view of the base member 214. FIG. 7 is a top view of the base member 214. FIG. 8 is a bottom view of the base member 214. FIG. 9 is a cross sectional view of the base member 214. The base member 214 a mounting flange 222 which can be mounted onto the outside structure of an article of footwear or other article, or the mounting flange 222 can be mounted underneath an outer structure of the article so that at least a portion of the mounting flange 222 is hidden from view. The mounting flange 222 can be secured to the article by stitching, or in any other suitable manner such as using an adhesive, or using rivets, etc. The mounting flange 222 can be contoured to fit a particular portion of the article (e.g., the back of a shoe), or the mounting flange can be flexible to fit a variety of shapes. The mounting flange 222 can extend fully or partially around the circumference of the housing 220. The mounting flange 222 can be somewhat resilient to accommodate the flexing of the article during use. In some embodiments, the mounting flange 222 can be omitted, and the base member 214 or housing 220 can be mounted to the article by a screw or rivet or other fastener. For example, a threaded portion of the base member 214 or housing 220 can be threaded into a corresponding threaded connector on the article. In some embodiments, the mounting flange 222 is connected to the article and the reel 204 is subsequently attached to the flange 222.

The housing 220 can be attached to, or integrally formed with, the mounting flange 222 and can extend upward therefrom, as illustrated. The housing 220 can include an outer wall 240 that surrounds a depression 242, which can be substantially circular in shape. A shaft 244 can extend axially upwardly from the base of the depression 242, and the shaft 244 can be aligned substantially coaxially with the depression 242. The shaft 244 can include a step 245 or beveled portion where the shaft 244 meets the base of the depression 242. The shaft 244 can include a bore 246 in the center thereof which can facilitate the securing of the knob member 218 to the housing 220. The bore 246 can be threaded or otherwise configured to axially secure a fastener that is inserted therein. The shaft 244 can form a supporting surface about which the spool member 216 can rotate.

The outer wall 240 of the housing 220 can be substantially cylindrical in shape and can be substantially coaxial with the shaft 244. The inner surface of the outer wall 240 can include a lower portion 248, and an upper portion 250. The lower portion 248 can be generally smooth and can include a step 251 or beveled portion where the outer wall 240 meets the base of the depression 242. The lower portion 248 can include one or more lace openings 252*a-b* which can be in connected to the lace holes 226*a-b* by lace channels 254*a-b* so that the lace 206 can pass through the housing 220 and enter the depression 242. As can best be seen in FIG. 9, a lower portion of the lace channels 254*a-b* nearest to the lace holes 226*a-b* can be closed while an upper portion of the lace channels 254*a-b* nearest to the lace openings 252*a-b* can be open at the top. Also, the lace channels 254*a-b* and/or the lace openings 252*a-b* can be in connected to openings 256*a-b* formed in the base of the housing 220. The openings 256*a-b* and the open tops of the lace channels 254*a-b* can provide access to the lace 206 during use and installation, and can also provide an exit pathway for water or other material that may enter the depression 242 during use, and can facilitate the molding of the lace channels 254*a-b* when the base member 214 is made of few components (e.g., a single integrated piece).

The housing 220 can include housing teeth 224 that extend radially inwardly from the upper portion 250 of the outer wall 240. In the illustrated embodiment, the housing includes 36 housing teeth 224, but any other suitable number of housing teeth 224 can be used. As can best be seen in FIG. 7, each of the housing teeth 224 can include a first side 258 and a second side 260. The first side 258 can be shorter than the second side 260, and in some embodiments, the first side 258 can be about half as long as the second side 260. In some embodiments, the first side 258 of the housing teeth 224 can be at least about 0.5 mm long and/or no more than about 1.0 mm long, and can be about 0.85 mm long, and the second side can be at least about 1.0 mm long and/or no more than about 2.0 mm long, and can be about 1.75 mm long. Other dimensions outside of these specific ranges are also possible. The first side 258 of the housing teeth 224 can be angled away from a line that points directly radially inwardly by and angle 262 that can be at least about 5° and/or at most about 15°, and can be about 10° in some embodiments. The second side 260 of the housing teeth 224 can be angled away from a line that points directly radially inwardly by an angle 264 that can be at least about 45° and/or no more than about 65°, and can be about 55° in some embodiments. Other angles outside these specially identified ranges are also possible. In some embodiments, the transition between housing teeth 224 and between the first and second sides 258, 260 of the housing teeth 224 can be curved, but hard edged transitions can also be used. The housing teeth 224 can be configured to interface with the pawls 236 as discussed in greater detail below. The housing teeth 224 can include angled top surfaces 266 to facilitate the transition of the pawls 236 from the disengaged to engaged positions as will be described in greater detail below.

The base member 214 can include one or more guard pieces 268 that can extend axially upwardly further than the outer wall 240 of the housing 220 such that the guard piece 268 can function to cover a portion of the knob member 218 when the knob member 218 is attached to the housing 220. In some embodiments, the guard piece 268 can be omitted. In some embodiments, the reel 204 can be disposed within a recess of the article such that a portion of the article itself extends to cover a portion of the knob member 218. The guard 268, or portion of the article functioning as a guard, can protect the knob member 218 and can reduce the occurrence of accidental disengagement of the knob member 218.

Figure 10A:
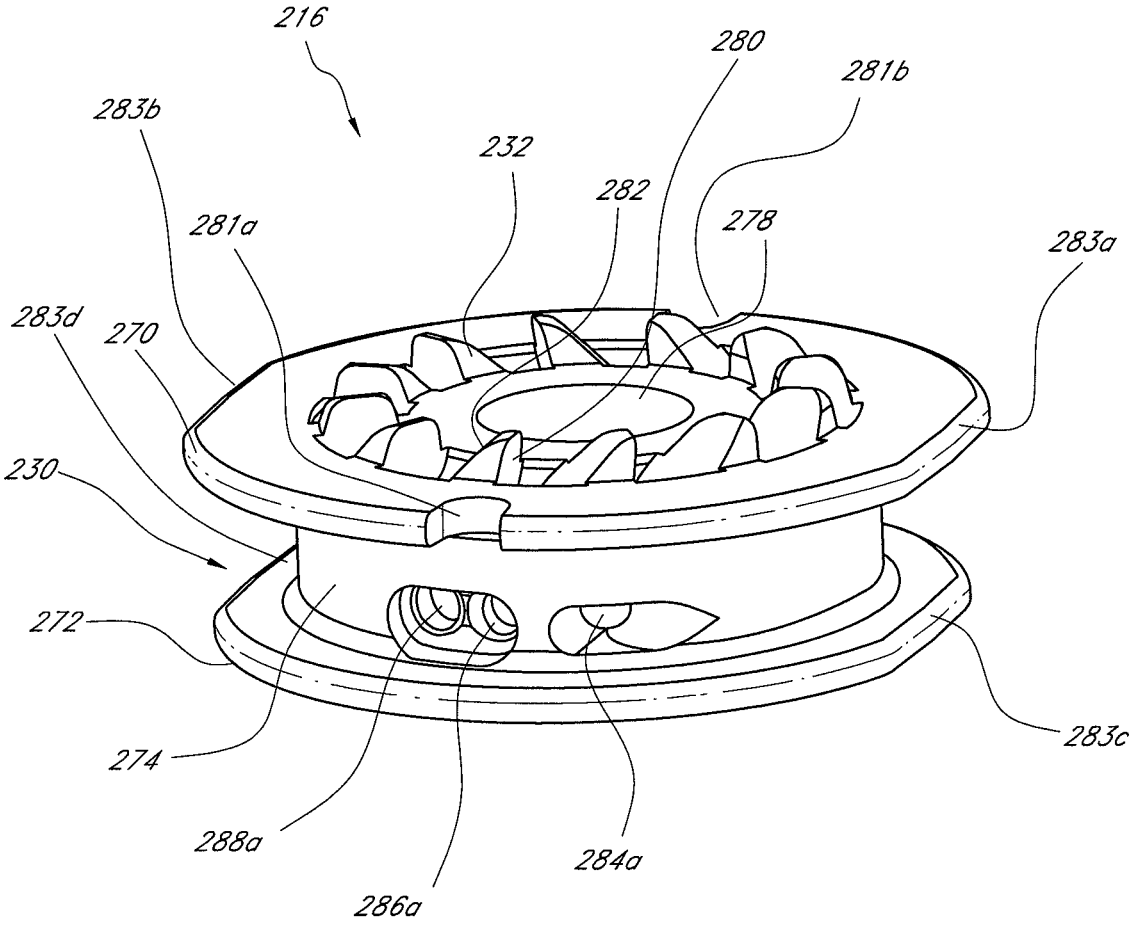
FIG. 10A is perspective view of the spool member from the reel of FIG. 3.
Figure 11:
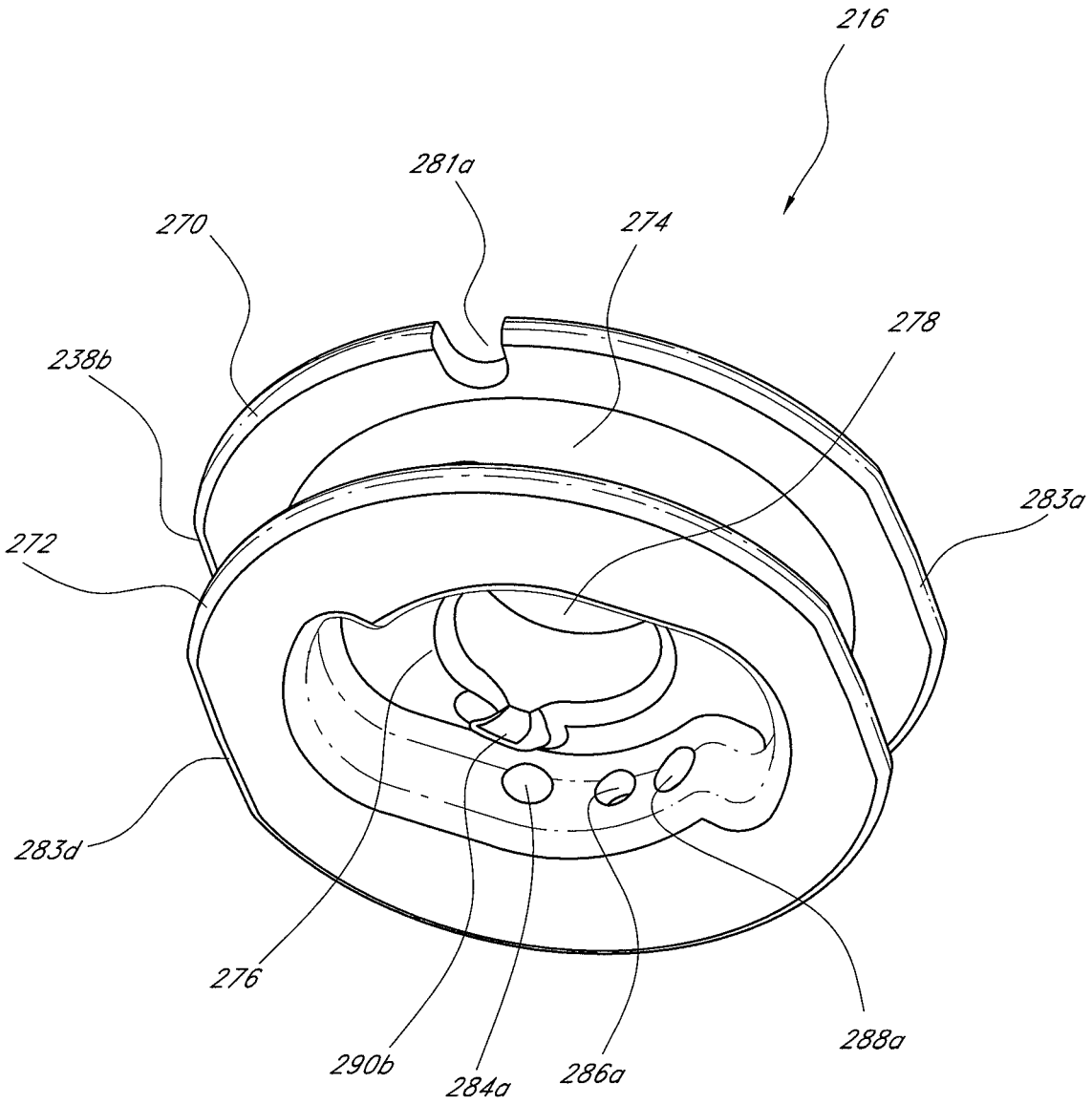
FIG. 11 is another perspective view of the spool member of FIG. 10A.
Figure 12:
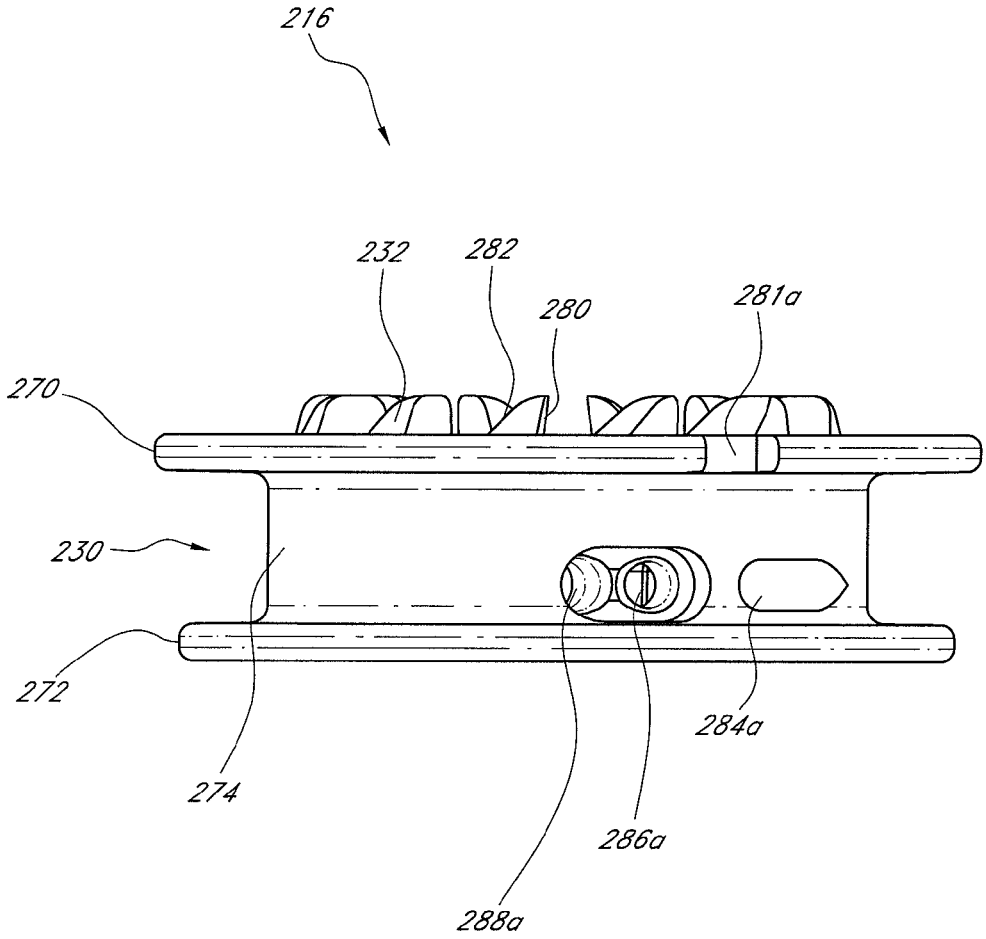
FIG. 12 is a side view of the spool member of FIG. 10A.
Figure 13A:
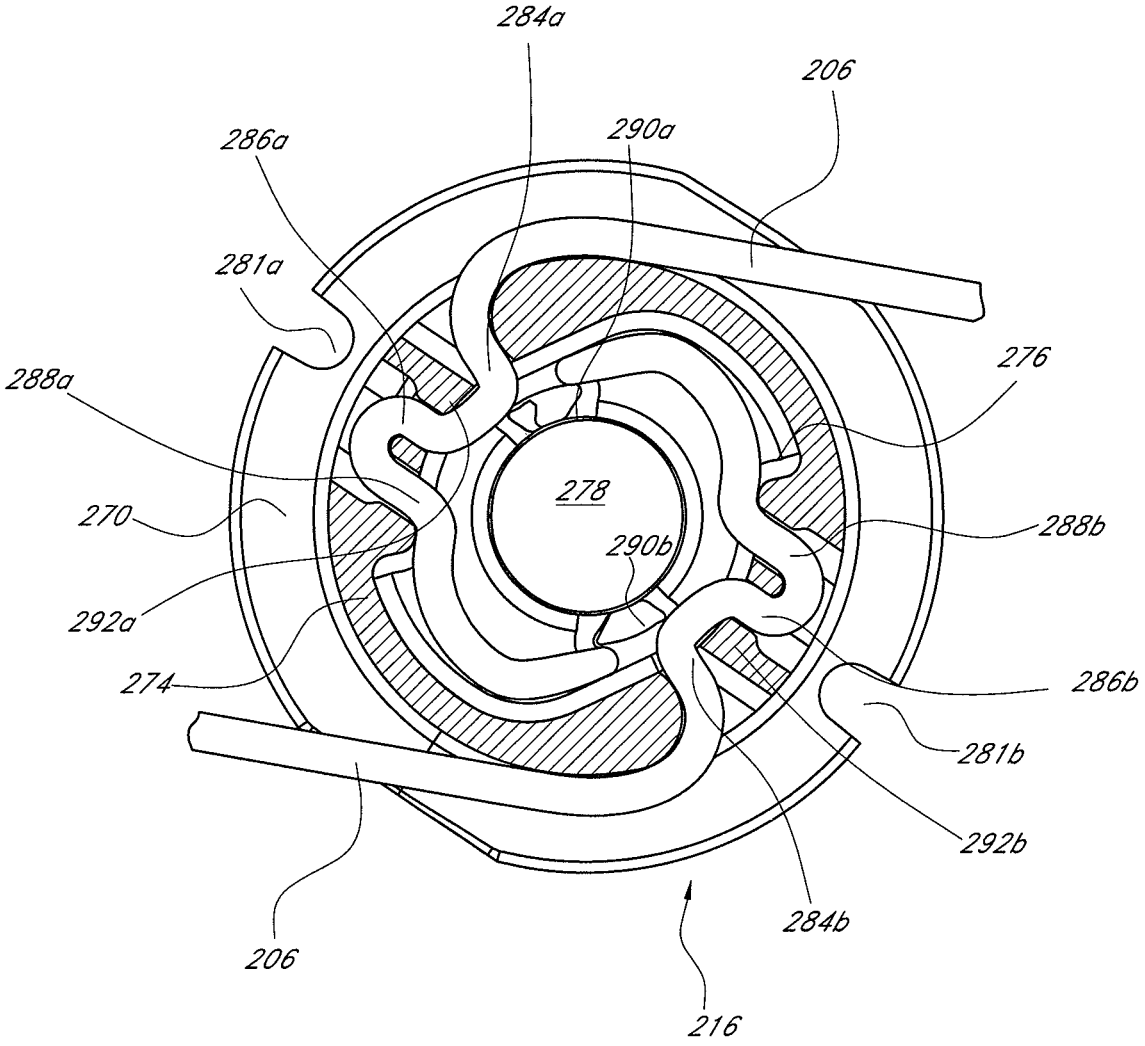
FIG. 13A is a cross sectional view of the spool member of FIG. 10A shown with a lace secured thereto in a first configuration.
Figure 13B:
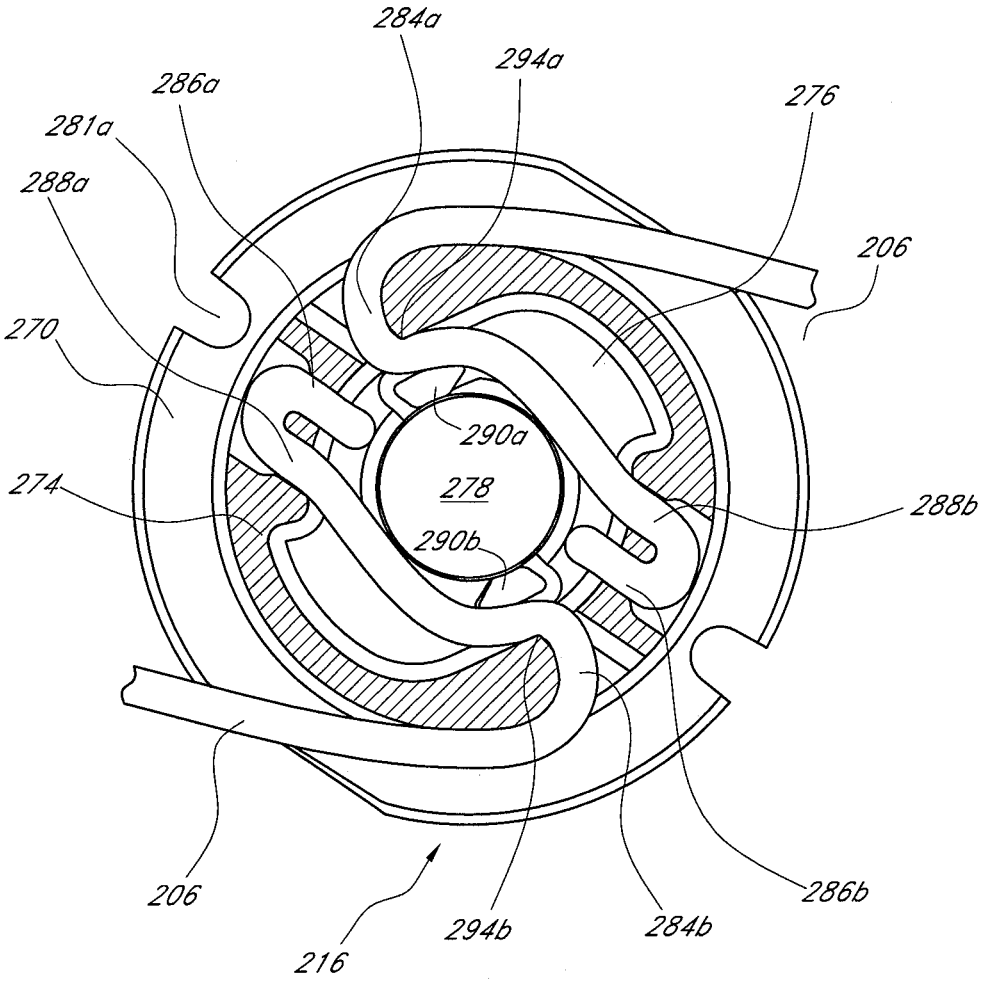
FIG. 13B is a cross sectional view of the spool member of FIG. 10A shown with a lace secured thereto in a second configuration.
Figure 14:
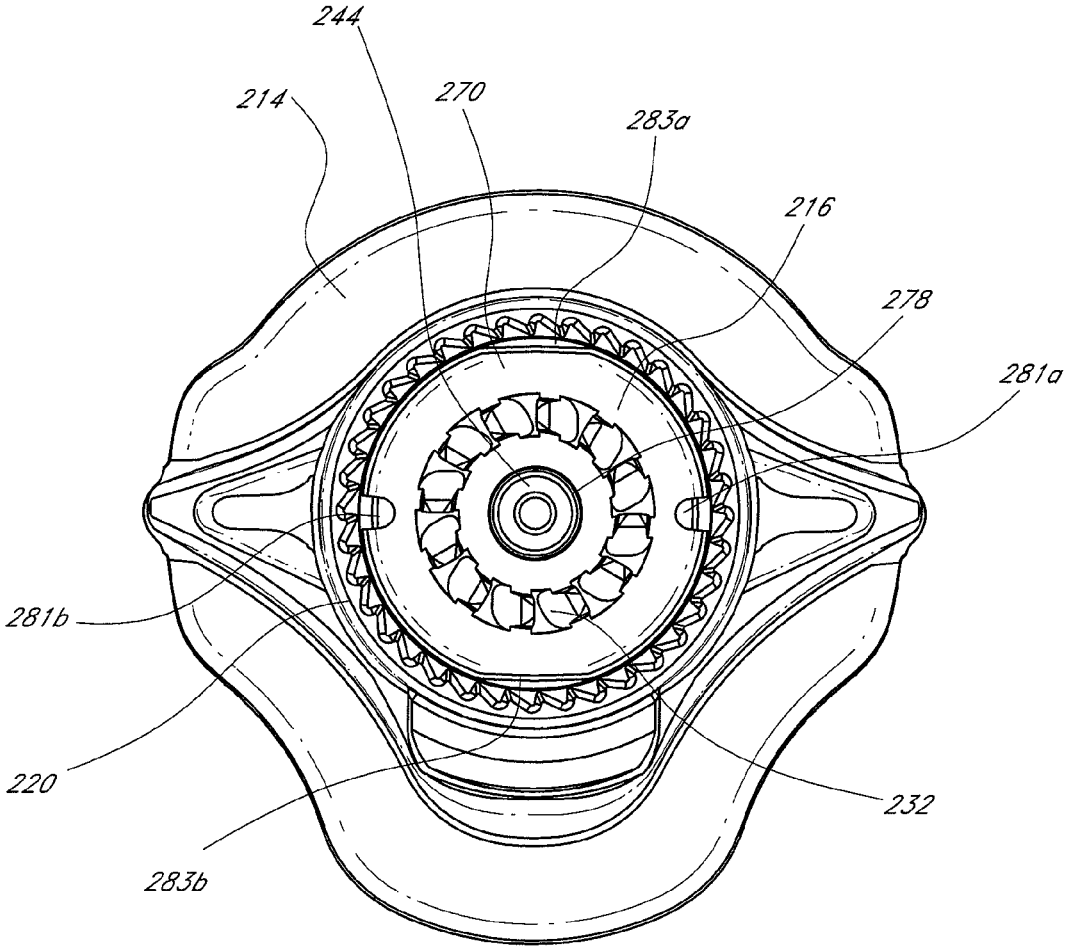
FIG. 14 is a top view of the spool member of FIG. 10A shown disposed in the housing of the base member of FIG. 4.

FIG. 10A is a perspective view of the spool member 216. FIG. 11 is another perspective view of the spool member 216. FIG. 12 is a side view of the spool member 216. FIG. 13A-B are a cross sectional bottom views of the spool member 216 with the lace 206 attached thereto. FIG. 14 is a top view of the spool member 216 disposed within the housing 220.

The spool member 216 can include an upper flange 270 and a lower flange 272 with a substantially cylindrical wall 274 formed therebetween. The outer surface of the wall 274, the bottom surface of the upper flange 270, and the top surface of the lower flange 272 can form a channel 230 for collecting the lace 206 as it is wound around the spool member 216. The inner surface of the wall 274 can surround a depression 276 formed in the bottom of the spool member 216. A central opening 278 can extend through the ceiling of the depression. As can best be seen in FIG. 14, when the spool member 216 is disposed within the depression 242 of the housing 220, the shaft 244 can pass through the central opening 278 of the spool member 216. The step 245 or beveled edge at the bottom of the shaft 244 can be received into the depression 276 formed in the bottom of the spool member 216. The lower flange 272 can be formed slightly smaller than the upper flange 270 (as can best be seen in FIG. 12) so that the lower flange 272 can fit inside the step 251 or beveled edge at the edge of the depression 242, and to facilitate removal and/or installation of the spool member 216 from/into the housing 220 with the lace 206 attached. Thus, in some embodiments, the bottom surface of the lower flange 272 can sit flush against the base of the depression 242. In some embodiments, a portion of the housing 220 can be configured to contact a portion of the spool member 216 to maintain the bottom surface of the lower flange 272 a small distance from the base of the depression to reduce the amount of friction as the spool member 216 rotates. When the spool member 216 is fully inserted into the depression 242 of the housing 220, the top surface of the upper flange 270 can substantially align with the top of the lower portion 248 of the outer wall 240 such that the upper flange 270 does not overlap the housing teeth 224.

Spool teeth 232 can be formed on the top surface of the spool member 216. In the illustrated embodiment, 12 spool teeth 232 are shown, but any other suitable number of spool teeth 232 can be used. Each of the spool teeth 232 can include a first side 280 and a second side 282. The first side 280 can be substantially vertical in some embodiments. In some embodiments, the first side can be angled by at least about 5° and/or by no more than about 15°, and in some embodiments by about 10° from the vertical plane. The second side 282 can be angled by at least about 35° and/or by no more than about 55°, and in some embodiments by about 45° from the vertical plane. The first side 280 can be at least about 1.5 mm long and/or no more than about 2.5 mm long, and can be about 2.0 mm long. The second side can be at least about 2.5 mm long and/or no more than about 3.5 mm long, and can be about 3.0 mm long. Dimensions and angles outside the identified ranges can also be used. The spool teeth 232 can be configured to interface with the knob teeth 234 as discussed in greater detail herein.

Figure 10B:
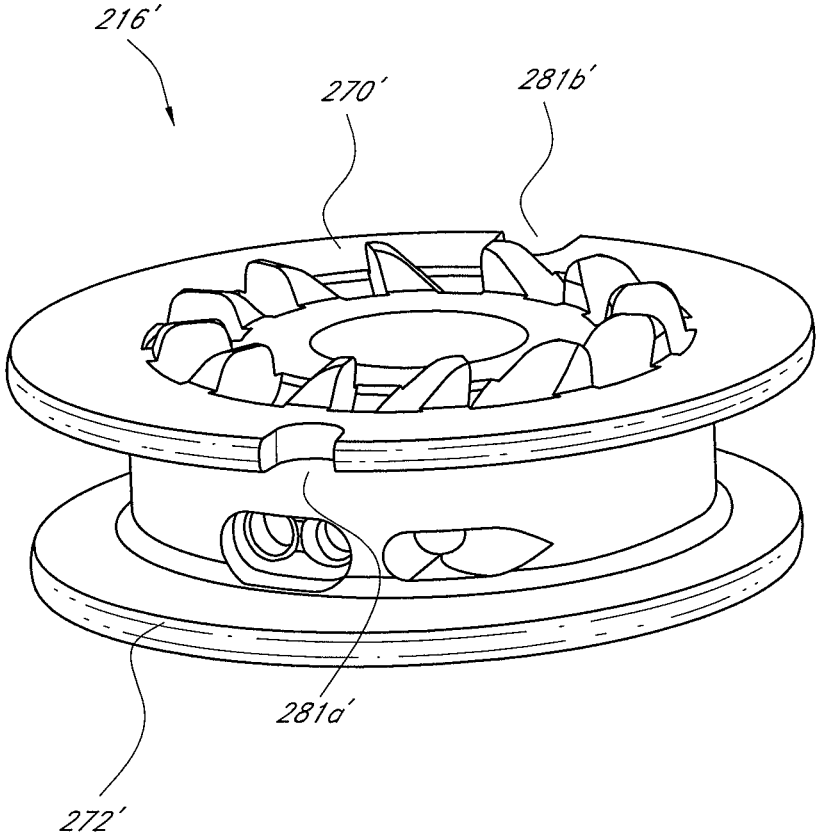
FIG. 10B is a perspective view of another embodiment of a spool member.

In some embodiments, one or more cutouts 281*a-b* can be formed in the upper flange 270 of the spool member 216. Also, in some embodiments, the upper flange 270 and/or the lower flange can be substantially circular in shape, but can have one or more flattened edges 283*a-d*. The cutouts 281*a-b* and/or the flattened edges 283*a-d* can facilitate the removal of the spool member 216 from the housing 220 (e.g., when replacing the lace 206). A screwdriver or other tool can be inserted between the spool member 216 and the housing 220 wall and the spool member 216 can be pried out of the housing 220. Many variations are possible. For example, FIG. 10B is a perspective view of a spool member 216' which is similar to the spool member 216 in many respects, except that the upper flange 270' and the lower flange 272' of the spool member 216' do not have flattened edges 283*a-d*. Thus, the upper flange 270' and the lower flange 272' can be substantially circular in shape. In some embodiments, the upper flange 270' can include cutouts 281*a*' and 281*b*' which can facilitate the removal of the spool member 216' from the housing 220. In some embodiments, the flanges 270' and 272' that do not include flattened edges 283*a-d* can prevent the lace 206 from becoming trapped or wedged in the gaps formed between the housing 220 and the flattened edges 283*a-d*, especially when a relatively thin lace is used.

The depth of the channel 230 can be at least about 1.5 mm and/or no more than about 2.5 mm, and in some cases can be about 2.0 mm. The channel 230 can have a width that is at least about 3.0 mm and/or no more than about 4.0 mm, and in some cases can be about 3.5 mm. The outer surface of the wall 274 can have a diameter of at least about 10 mm and/or no more than about 20 mm, and can be in some cases about 14 mm. Dimensions outside the given ranges are also possible. The lace 206 can be generally small enough in diameter that the cannel 230 can hold at least about 300 mm of lace and/or no more than about 600 mm of lace, and in some embodiments about 450 mm of lace, although the spool member 216 and lace 206 can be configured to hold amounts of lace outside these given ranges.

The lace or cable can have a diameter of at least about 0.5 mm and/or no more than about 1.5 mm, and in some embodiments the diameter can be about 0.75 mm or 1.0 mm, although diameters outside these ranges can also be used. The lace 206 can be a highly lubricious cable or fiber having a low modulus of elasticity and a high tensile strength. In some embodiments, the cable can have multiple strands of material woven together. While any suitable lace can be used, some embodiments can utilize a lace formed from extended chain, high modulus polyethylene fibers. One example of a suitable lace material is sold under the trade name SPECTRA™, manufactured by Honeywell of Morris Township, N.J. The extended chain, high modulus polyethylene fibers advantageously have a high strength to weight ratio, are cut resistant, and have very low elasticity. One preferred lace made of this material is tightly woven. The tight weave provides added stiffness to the completed lace. The additional stiffness provided by the weave offers enhanced pushability, such that the lace is easily threaded (e.g., into the reel 204). Additionally, in some embodiments, the lace can be formed from a molded monofilament polymer. In some embodiments, the lace can be made from woven steel with or without a polymer or other lubrication coating.

One or more ends of the lace 206 can be secured to the spool member 216. In some embodiments, the lace 206 can be removably or fixedly attached to the spool member 216. In some embodiments, the lace 206 can be threaded through a hole formed in the spool member 216 and a knot can be formed in the end of the lace 206, or an anchoring member can be attached thereto, to prevent the end from being pulled back through the hole. In some embodiments, the lace 206 can be tied to a portion of the spool member 216. The lace can also be secured to the spool member 216 by an adhesive any other suitable manner. In some embodiments, the lace 206 is secured to the spool member 216 by weaving the lace 206 through a series of openings that cause the lace 206 to turn at such angles so as to produce sufficient friction to prevent the lace 206 from being dislodged from the spool member 216. In some embodiments, the lace 206 wraps over itself so that the lace 206 tightens on itself when pulled. In some embodiments, only one end of the lace 206 is secured to the spool member 216, with the other end of the lace 206 being secured to the base member 214 or to the article being tightened.

The spool member 216 can include a first set of lace holes 284*a*, 286*a*, 288*a* which can be configured to secure a first end of the lace 206. In some embodiments, a second set of lace holes 284*b*, 286*b*, 288*b* can be used to secure the second end of the lace 206. Lace guides 290*a-b* can also be formed in the depression 276 to facilitate the securing of the lace 206 to the spool member 216.

In the embodiment shown in FIG. 13A, a first end of the lace 206 can pass through the lace hole 284*a* into the depression 276. The lace guide 290*a* can direct the lace 206 toward the lace hole 286*a*, and in some embodiments, the lace guide 290*a* can be positioned such that the lace 206 is wedged between the lace guide 290*a* and a portion 292*a* of the wall 274 between the holes 284*a* and 286*a*. The lace 206 can exit the depression 276 through the lace hole 286*a* and then turn an angle of approximately 180° to reenter the depression through the lace hole 288*a*. In some embodiments, the tip of the first end of the lace 206 can be tucked into the opposing lace guide 290*b* to prevent the tip from moving about within the depression 276 and interfering with the rotation of the spool member 216. In some embodiments, the amount of lace 206 that passes through the lace holes 284*a*, 286*a*, 288*a* can be configured so that only a small portion of the lace 206 reenters the depression 276 through the hole 288*a* so that the tip is not tucked into the opposing lace guide 290*b*. The second end of the lace 206 can be secured to the spool member 216 by the lace holes 284*a*, 286*b*, 288*b*, and the lace guide 290*b*, and the portion 292*b* of the wall 274 in like manner.

Other lace securing configurations are possible. For example, in the embodiment shown in FIG. 13B, the first end of the lace 206 passes through the lace hole 284*a* to enter the depression 276. The lace guide 290 can direct the lace 206 toward the lace hole 288*b*, and the lace guide 290*a* can be configured such that the lace 206 is wedged between the lace guide 290*a* and the portion 294*a* of the wall adjacent to the lace hole 284*a*. The lace 206 can pass through the lace hole 288*b* and then turn an angle of approximately 180° to reenter the depression 276 through the lace hole 286*b*. The second end of the lace 206 can be secured to the spool member 216 by the lace holes 284*b*, 288*a*, 286*a*, and the lace guide 290*b* and the portion 294*b* of the wall 274 in like manner.

Figure 13C:
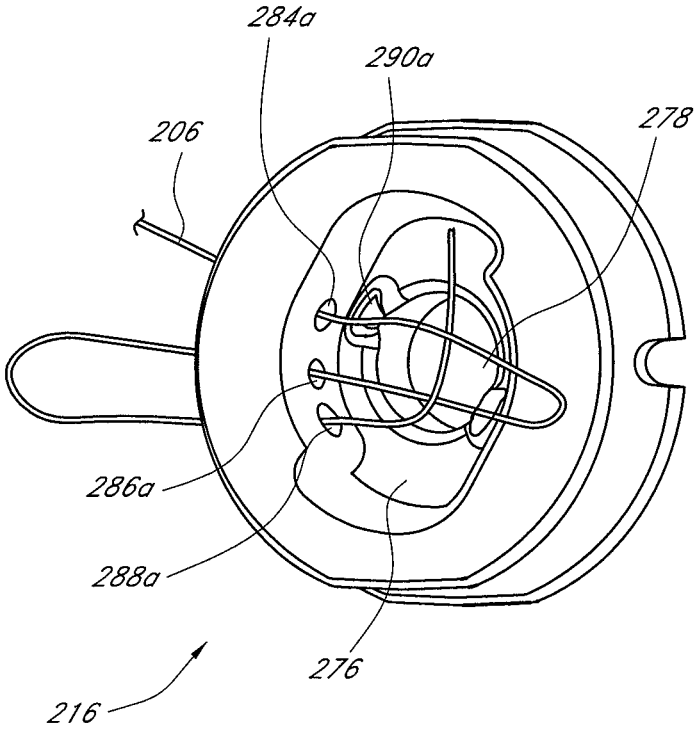
FIG. 13C is a perspective view of the spool member of FIG. 10A showing a lace being secured to the spool member in a third configuration.
Figure 13D:
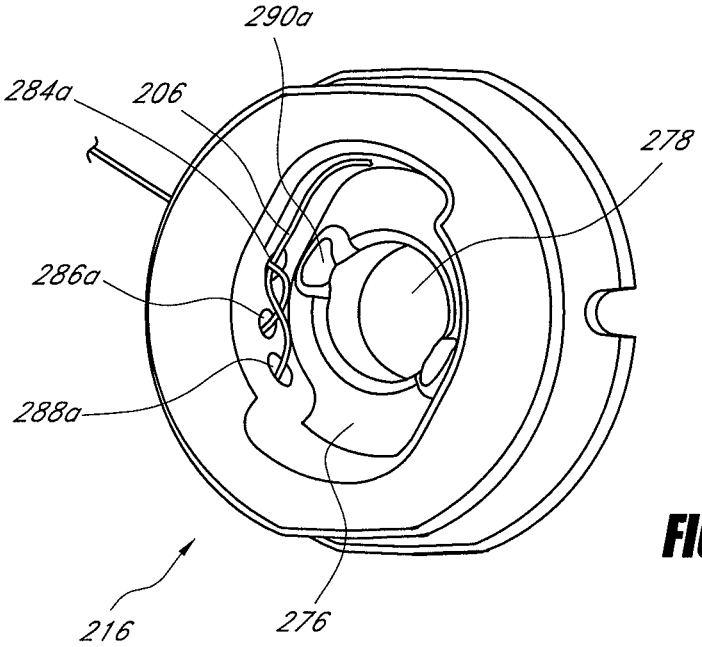
FIG. 13D is a perspective view of the spool member of FIG. 10A showing the lace

FIGS. 13C and 13D illustrate another manner in which the lace 206 can be secured to the spool member 216. As shown in FIG. 13C, the end of the lace 216 is threaded through the lace hole 284*a* into the depression 276, then through the lace hole 286*a* out of the depression 276, and then through the lace hole 288*a* back into the depression 276. The end of the lace 206 can then be passed through the loop in the lace formed between the lace holes 284*a*, 286*a*, as shown in FIG. 13C. The lace 206 can then be tightened so that the lace crosses under itself as shown in FIG. 13D. For example, the loose end of the lace 206 can be held with one hand while pulling the loop formed between the lace holes 284*a* and 286*a* to remove the slack from the loop formed between the lace holes 286*a* and 288*a*. Then the slack in the loop formed between the lace holes 284*a* and 286*a* can be pulled out of the depression 276 through the lace hole 284*a* until the lace tightens down on itself. Thus, once tightened, the lace 206 bears down on itself more tightly when it is pulled, thereby preventing the lace 206 from disengaging from the spool member 216.

The lace can pass over the top of the portion of the loop that is closest to the lace hole 288*a* and then under the portion of the loop that is furthest from the lace hole 288*a*, as shown. Then, when the lace is tightened, the loose end of the lace 206 can be directed generally toward the base of the depression 276, rather than being directed generally out from the depression 276 as would be the case if the lace were threaded over the top of the portion of the loop furthest from the lace hole 288*a*. By biasing the loose end of the lace toward the base of the depression 276, the loose end of the lace can be prevented from interfering with the insertion of the spool member 216 into the housing 220. The lace guide 190*a* can be positioned to keep the loose end of the lace 206 positioned near the periphery of the depression 276 so that the loose end of the lace 206 does not enter the central opening 278 or otherwise interfere with the spool member 216 being inserted into the housing 220.

Figure 15:
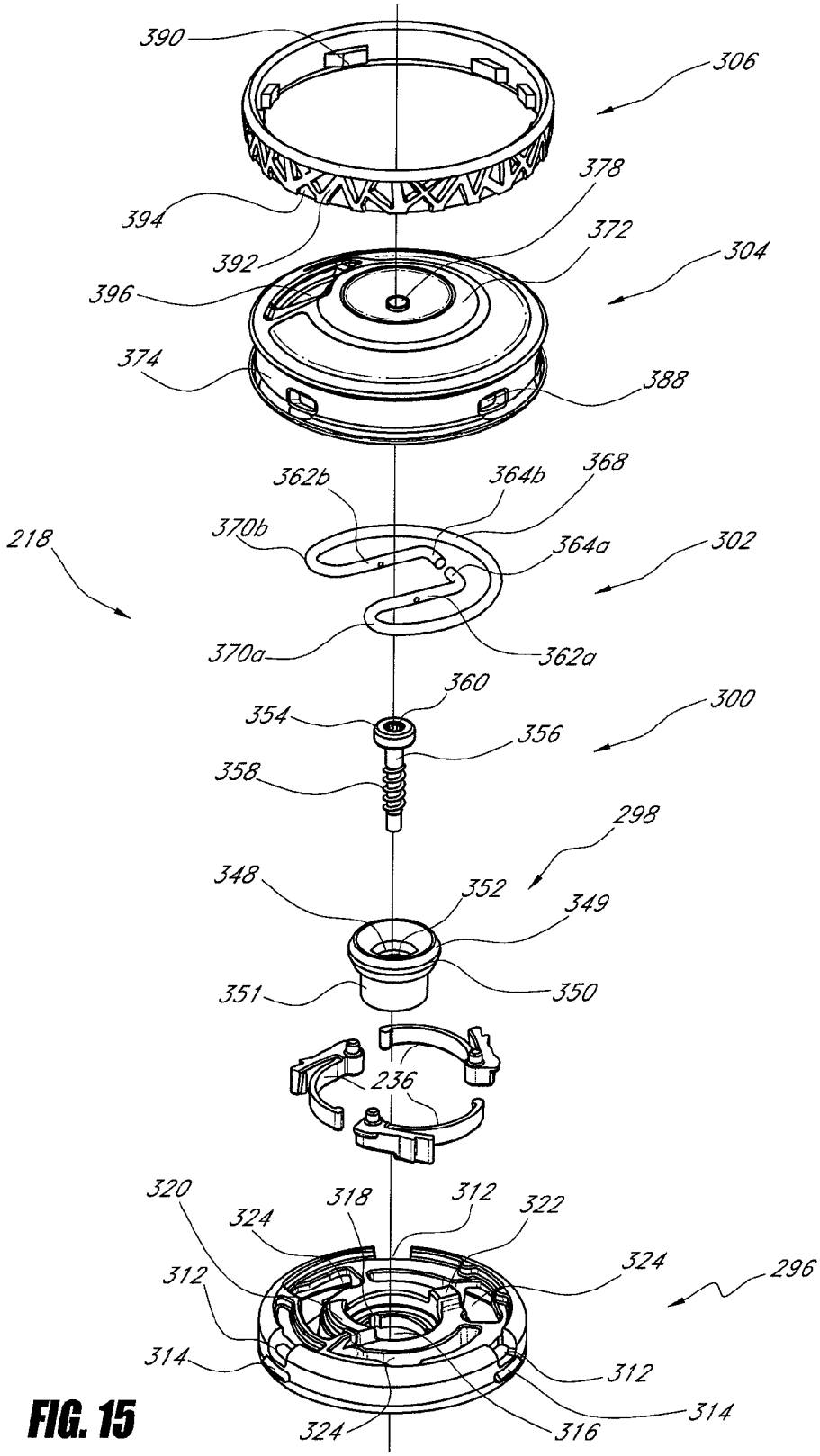
FIG. 15 is an exploded perspective view of the knob member from the reel of FIG. 3.
Figure 16:
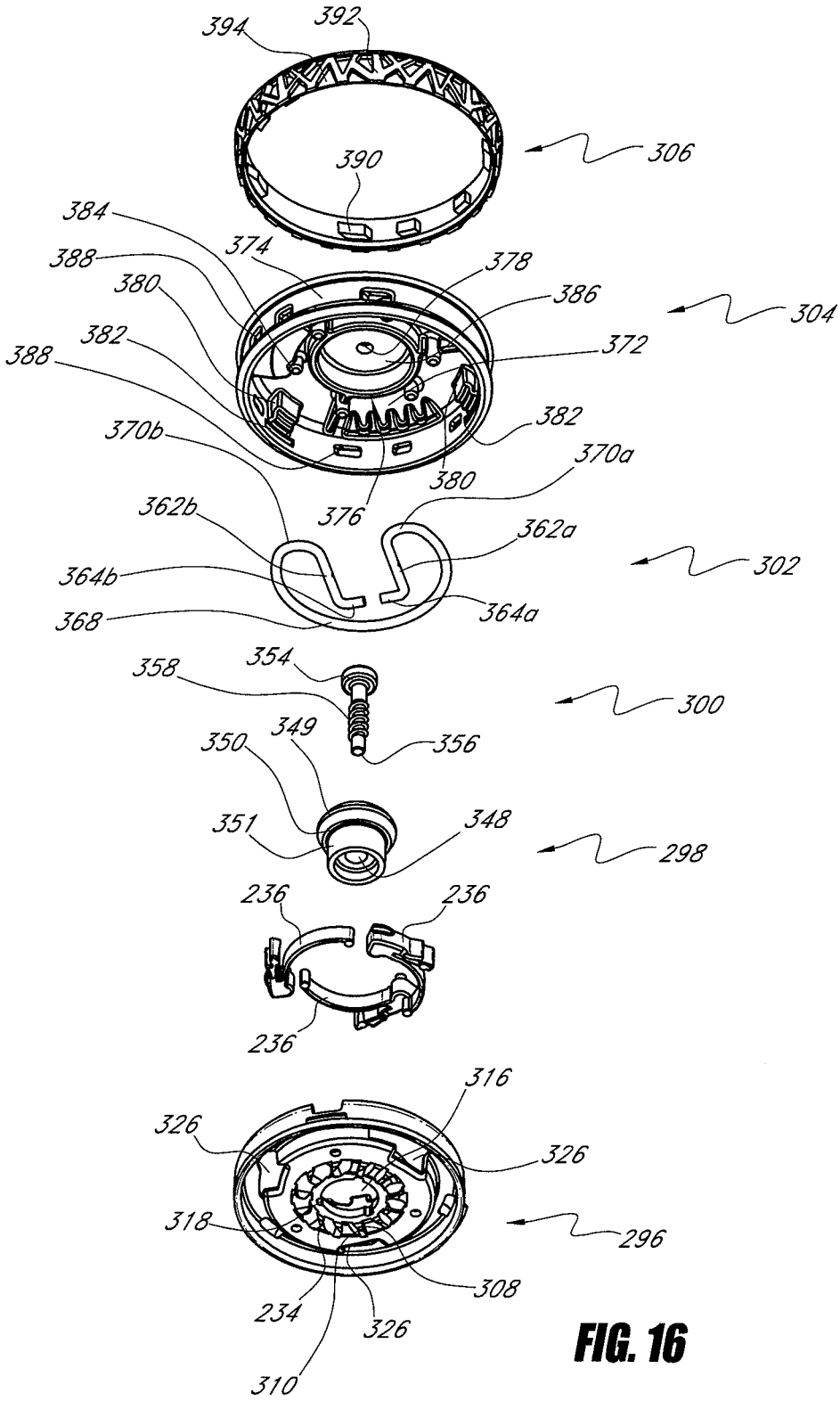
FIG. 16 is another exploded perspective view of the knob member from FIG. 15.

FIG. 15 is an exploded perspective view of the knob member 218. FIG. 16 is another exploded perspective view of the knob member 218. The knob member can include a knob core 296, pawls 236, a spring bushing 298, a fastener 300, a knob spring 302, a knob cover 304, and a knob grip 306.

The knob core 296 can be generally disc-shaped. The knob core 296 can include knob teeth 234 formed on the bottom surface thereof. In the illustrated embodiment 12 knob teeth 234 are shown, but any other suitable number of knob teeth 234 can be used. In some embodiments, the same number of knob teeth 234 and spool teeth 232 can be used, and the knob teeth 234 can be shaped similar to, or the same as, the spool teeth 232, except that that the knob teeth 234 are oriented in the opposite direction so that the knob teeth 234 can engage the spool teeth 232. Accordingly, the dimensions described above in connection with the spool teeth 232 can also apply to the knob teeth 234. When the knob member 218 is rotated in the tightening direction, the first sides 308 of the knob teeth 234 can press against the first sides 280 of the spool teeth 232 to drive the spool member 216 in the tightening direction. When a lace 206 is tightened around the spool member 216 applying a force to the spool member 216 to cause it to tend to twist in the loosening direction, the second sides 282 of the spool teeth 232 can bear against the second sides 310 of the knob teeth 234 so that the force is transferred to the knob member 218 to cause it to tend to twist in the loosening direction. As will be discussed below, the force can cause the pawls 236 to engage with the housing teeth 224 to prevent the knob member 218 and the spool member 216 from rotating in the loosening direction, thereby maintaining the lace 206 in the tightened configuration.

The knob core 296 can include features to facilitate the securing of the knob cover 304 thereto. The knob core 296 can include notches 312 formed in the top surface thereof near the periphery of the knob core 296. Protrusions 314 can extend radially outwardly from the periphery of the knob core 296 at locations below the notches 312. The knob core 296 can include a central opening 316 through the center thereof, which can be configured to accept the spring bushing 298. A top portion of the central opening 316 can be wider than a lower portion of the central opening 316 forming a step 318 therein. The knob core 296 can also include features to facilitate the securing of the knob spring thereto, including, for example, a wide engagement tab 320 and a narrow engagement tab 322.

The knob core 296 can also include pawl depressions 324, configured to accept the corresponding pawls 236. The pawl depressions 324 can be generally shaped similarly to the pawls 236, but can be somewhat larger than the pawls 236 to allow the pawls 236 to pivot and move within the pawl depressions 324 during operation, as is described in greater detail elsewhere herein. The pawl depressions 324 can include pawl openings 326 formed in a portion of the base and/or side thereof to allow a portion of the pawls (e.g., the pawl teeth) to extend through the knob core 296 (as can be seen in the assembled knob member 218 shown in FIG. 4) and interface with the housing teeth 224.

Figure 17:
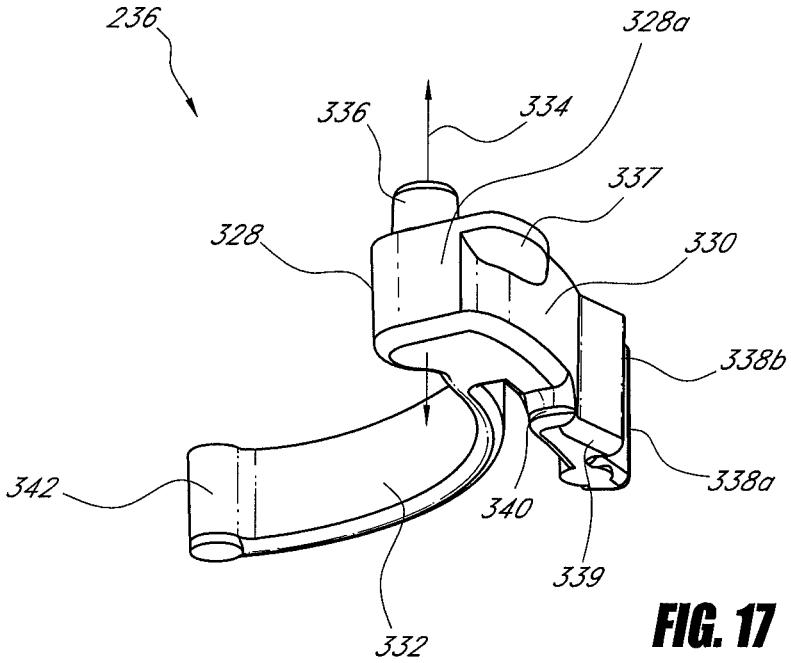
FIG. 17 is a perspective view of a pawl from the knob member of FIG. 15.
Figure 18:
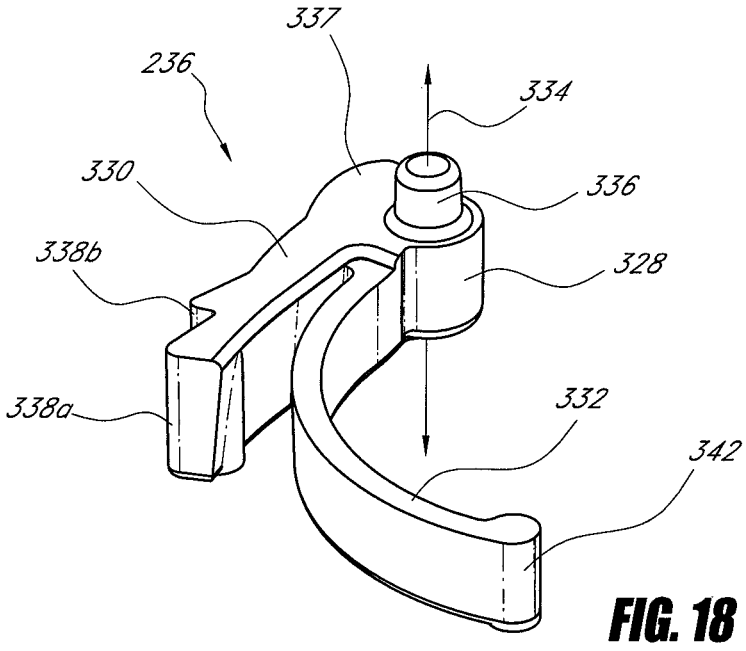
FIG. 18 is another perspective view of the pawl from the FIG. 17.

FIGS. 17 and 18 are perspective views of a pawl 236. The pawl 236 can include a pawl base 328, a pawl beam 330, and a pawl spring 332. The pawl base 328 can be configured to interface with the knob core 296 and/or the knob cover 304 so that the pawl 236 can pivot about an axis 334. A pivot tab 336 can extend upward from the pawl base 328 along the axis 334. The pivot tab 336 can be substantially cylindrical in shape and can be coaxial with the axis 334. A flange 337 can extend out from one side of the pawl base 328, and the flange 337 can facilitate the pivoting of the pawl 236. As can be seen in FIGS. 17 and 18, in some embodiments, the pawl beam 330, the pawl spring 332, and other components of the pawl 236 can be integrally formed (e.g., molded) as a single piece.

The pawl beam 330 can be formed of a material, thickness, and length such that the pawl beam 330 is substantially rigid and does not flex as the pawl 236 is displaced by the housing teeth 224 when the knob member 218 is rotated in the tightening direction. One or more pawl teeth 338*a-b* can be positioned near the end of the pawl beam 330 opposite the pawl base 328. In the embodiment shown, two pawl teeth 338*a-b* are used, but any other suitable number of pawl teeth 338*a-b* can be used instead. The pawl teeth 338*a-b*, and in some cases the entire pawl beam 330, can have an angled or beveled bottom surface 339 which can facilitate the transition of the knob member 218 from the disengaged position to the engaged position, as is discussed in greater detail elsewhere herein. The pawl beam 330 can include a step 340 formed where the end of the pawl beam 330 extends lower than the rest of the pawl 236. The downward extending portion of the pawl beam can be configured to extend through, or into, the pawl opening 326 formed in the pawl depression 324 of the knob core 296.

Figure 19:
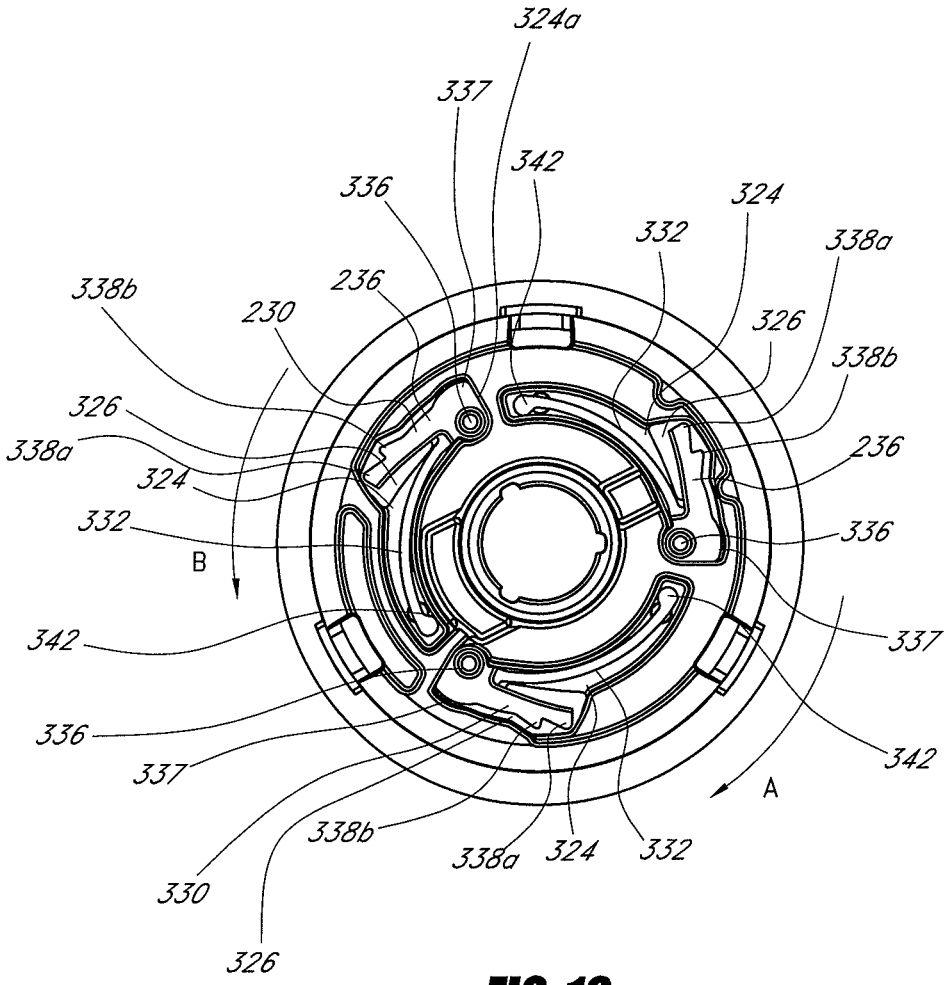
FIG. 19 is a top view of the pawls of FIG. 15 disposed in the knob core of FIG. 15, with the pawls configured to engage the housing teeth of the housing.

The pawl base 328 can include an end surface 328*a* configured to engage surface 324*a* of pawl depression 324 (as can be seen in FIG. 19). In some embodiments, as pressure is applied to one or more pawl teeth 338, the load can be transferred through pawl beam 330 to the engagement of end surface 328*a* and surface 324*a*. In some embodiments, as the pawl 236 pivots radially outwardly about the axis 334, the end surface 328*a* of the pawl base 328 can abut against the surface 324*a* of the pawl depression 324, thereby limiting the distance that the pawl 326 can pivot radially outwardly. For example, the pawl 236 can be permitted to pivot radially outwardly enough to engage the housing teeth 224, but not significantly further. This can relieve pressure off of the pawls 236 when a loosening force is applied to the knob member 218, which can produce a component of force urging the pawls 236 radially outward, as discussed below. The interface between the surfaces 328*a* and 324*a* can also limit the radial movement of the pawls 236 when the knob member 218 is in the disengaged position, thereby keeping the pawls 236 radially inward enough that the knob member 218 can be pressed to the engaged position without substantial interference from the pawls 236. In some embodiments, pawl 236 is positioned in pawl depression 324 and is generally trapped between the knob cover 304 and the knob core 296. As explained below, top tabs 384 can engage pivot tab 336 to inhibit axial movement of the pawl 236. Similarly, beam tabs 385 extending downward from knob cover 304 can engage the upper surface of the pawl beam 330 to inhibit axial movement thereof.

The pawl spring 332 can be a cantilever or arch spring as shown in the illustrated embodiment, but any other suitable type of spring can be used. The pawl spring 332 can extend out from the pawl base 328 in the same general direction as the pawl beam 330. The pawl spring 332 can be curved away from the pawl beam 330. A generally cylindrically shaped end piece 342 can be formed at the end of the pawl spring. The pawl spring 332 can be made of a material, thickness, and length such that the pawl spring 332 is resiliently flexible so that it flexes as the pawl 236 is displaced by the housing teeth 224 when the knob member 218 is rotated in the tightening direction. The pawl spring 332 is shown in the relaxed position in FIGS. 17 and 18. In some embodiments, the pawl beam 330 and the pawl spring 332 are independently formed and then coupled to form the pawl 236. Thus, pawl beam 330 and pawl spring 332 need not be formed of the same material. For example, a metal pawl beam 330 may be advantageous because of its relatively high strength to thickness ratio while it may be advantageous to use a plastic pawl spring 332. In some embodiments, the same material may be used in each, even when the beam pawl beam 330 and the pawl spring 332 are separately formed. In the illustrated embodiment of FIGS. 17-18, the pawl spring 332 and the pawl beam 330 can be integrally formed of the same material as a single piece, thereby simplifying the manufacturing and assembly cost and complexity. In some embodiments, different springs may be used than that shown in the illustrated embodiments. For example, a metal or plastic leaf spring or a wire coiled spring may be used in some applications.

Because the pawl beam 330 and pawl spring 332 are separate portions, the pawl spring 332 can be altered to be more easily flexible (e.g., by making the pawl spring 332 thinner) without reducing the amount of force the pawl beam 330 is able to withstand as the knob member 218 is twisted in the loosening direction. Likewise, the pawl beam 330 can be altered so that it can withstand greater force applied to the knob 218 in the loosening direction (e.g., by making the pawl beam 330 thicker) without making the pawl spring 332 less flexible. Thus, the pawl 236 can be tuned to a desired level of flexibility and strength. For example, a pawl 236 can be configured to withstand large amounts of force when the knob member 218 is twisted in the loosening direction while also being easily radially displaceable when the knob member 218 is rotated in the tightening direction. In some embodiments, the force applied to the pawl 236 when the knob member 218 is twisted in the loosening direction is born by the pawl beam 330 and substantially none of the force is born by the pawl spring 332. This configuration can be advantageous over embodiments in which a pawl includes a load bearing beam that also flexes to displace the pawl (e.g., during tightening), because the load bearing capability of the flexible pawl is reduced as the pawl is made more flexible, and the flexibility of the pawl is reduced as the beam is made to withstand higher forces. Thus, when using the flexible beam pawl, a sufficient amount of loosening force can cause the pawl beam to buckle, thereby compromising the lacing system. However, when using the pawls 236, the pawl beam 330 can be configured to be substantially rigid even when a relatively large loosening force is applied, and the pawl spring 332 can be configured to allow the pawl beam 330 to pivot easily when a tightening force is applied.

Figure 20:
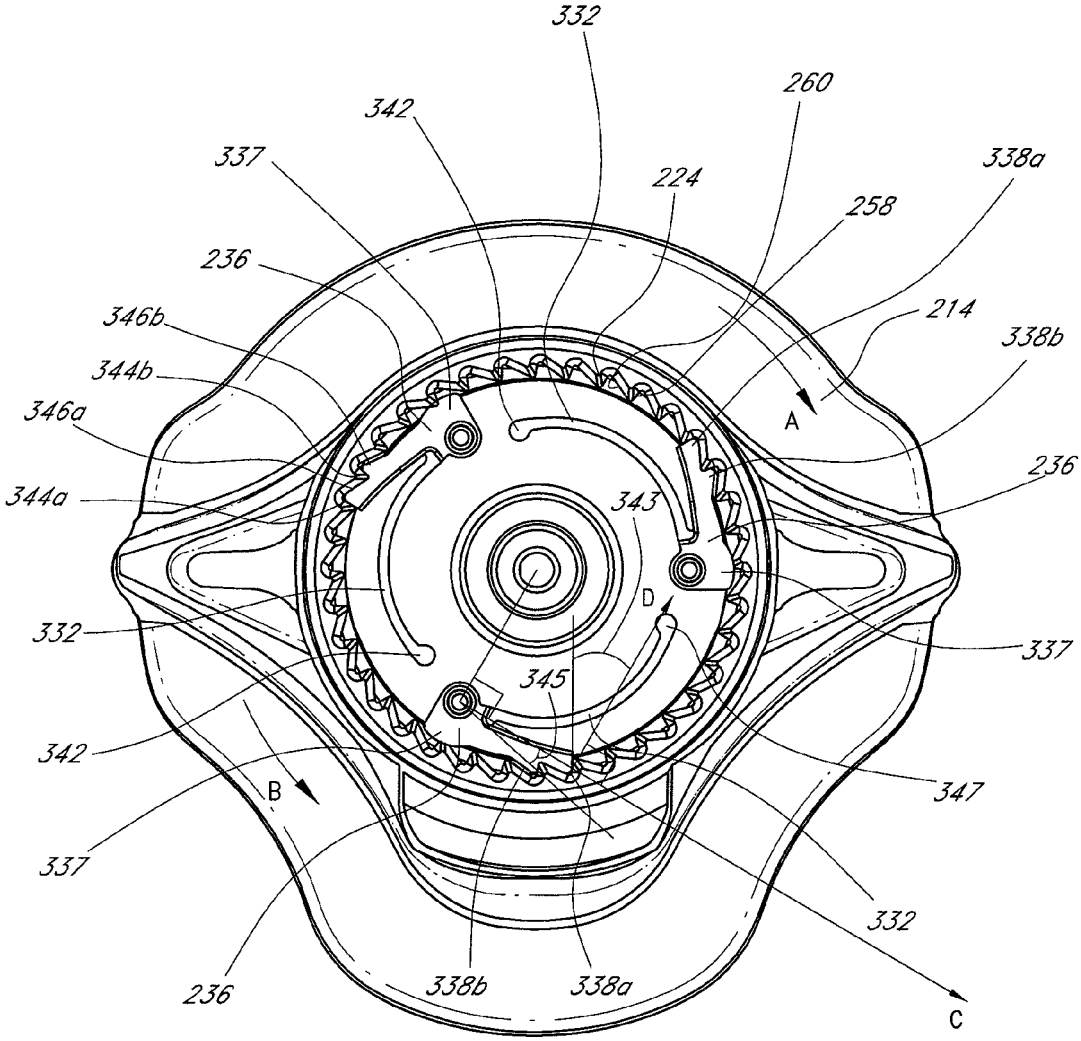
FIG. 20 is a top view of the pawls of FIG. 15 shown engaged with the housing teeth on the base member of FIG. 4.
Figure 21:
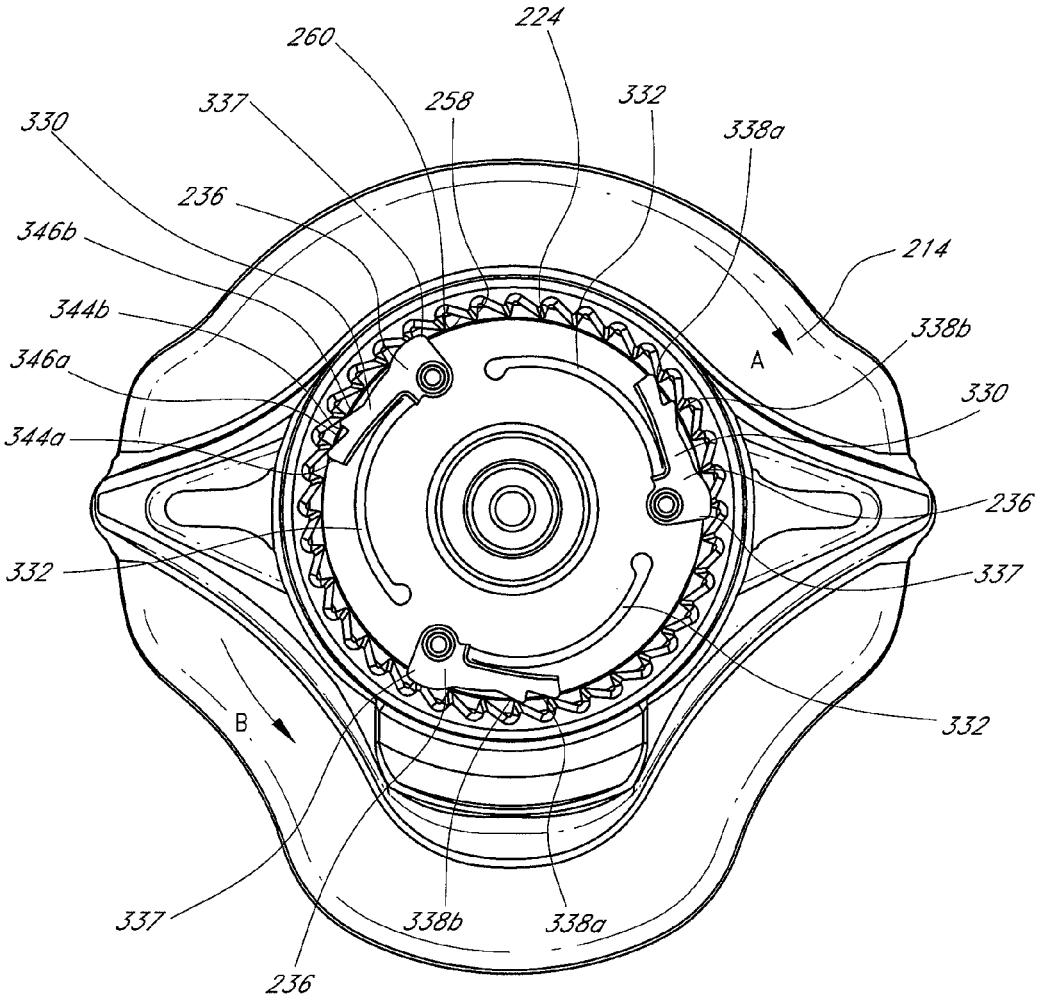
FIG. 21 is a top view of the pawls of FIG. 15 shown displaced radially inwardly as the knob member is rotated in the tightening direction.

FIG. 19 is a top view showing the pawls 236 positioned inside of the pawl depressions 324 of the knob core 296. Although the housing 220 is not shown in FIG. 19, the pawls 236 are shown in the position where the pawl teeth 338*a-b* are engaged with the housing teeth 224. FIG. 20 is a top view showing the base member 214 and the pawls 236 in the same position as in FIG. 19 with the pawl teeth 338*a-b* engaged with the housing teeth 224. FIG. 21 is a top view of the base member 214 and the pawls 236 in a displaced configuration as the knob member 218 is rotated in the tightening direction. The elements of the knob member 218, other than the pawls 236, and the spool member 216 are omitted from the view shown in FIGS. 20 and 21 for simplicity.

In some embodiments, the pawl springs 332 can be partially flexed to a position that is less curved than the relaxed position when inserted into the pawl depressions 324. The flexed pawl springs 332 can cause the pawls 236 to tend to pivot so that the pawl beams 330 are biased radially outwardly and so that the pawl teeth 338*a-b* bear radially outwardly against the housing teeth 224. When the knob member 218 is twisted in the loosening direction (shown by arrow B) the first sides 344*a-b* of the pawl teeth 338*a-b* can bear against the first sides 258 of the housing teeth 224 to prevent the knob member 218 from rotating in the loosening direction. In some embodiments, the pawl depressions 324 can be configured to receive the pawls 236 without the pawl springs 332 needing to be partially flexed. Thus, in some embodiments, the pawl springs 332 can be in the relaxed position when the pawl beams 330 are engaged with the housing teeth 224 to prevent the knob 218 from loosening. When the pawl beams 330 are displaced away from the housing teeth 224, the pawl springs 332 can transition from a relaxed to a flexed state such that the pawl beams 330 are biased toward the housing teeth 224. Also, as shown for example in FIG. 20, in some embodiments, one or more of the pawl teeth 338*a-b* can engaged the housing teeth 224 at locations that are radially outside a tangent line that extends from the pivot axis 334 of the pawl 236. In the embodiment of FIG. 20, the pawl tooth 338*b* can engage the corresponding housing tooth 224 at a location on a line that is angled radially outward from the tangent line C by an angle 345 that is at least about 5° and/or less than or equal to about 15°, and can be about 10° in some embodiments. Thus, when a loosening force is applied to the knob member 218 (shown by arrow B), a component of the force is directed to urge the pawl 236 to pivot radially outwardly. Thus, as more loosening force is applied to the knob member 218, the pawl teeth 338*a-b* are urged to engage the housing teeth 224 more firmly. This can prevent the pawls 236 from unintentionally disengaging from the housing teeth 224 when a large loosening force is applied. As the pawl 236 is urged radially outward, the pawl beam can abut against the tips of one or more housing teeth 224 not engaged by the pawl teeth 338*a-b*, which can prevent the pawl beam 330 from buckling outwardly and can transfer some of the loosening force into the housing. As discussed above, the surface 328*a* of the pawl base 328 can abut against the surface 324*a* of the pawl depression 324, thereby limiting the amount that the pawl 236 can rotate radially outwardly.

In some embodiments, multiple pawl teeth 338*a-b* can be used so that the multiple pawl teeth 338*a-b* simultaneously engage multiple corresponding housing teeth 224 so that, when the knob member 218 is twisted in the loosening direction, the applied force is distributed across multiple teeth per pawl 236 to prevent the knob member 218 from rotating in the loosening direction. By distributing the force across multiple teeth, the housing teeth 224 and pawl teeth 338*a-b* can relatively small in size while still providing sufficient engagement surface area between the first sides 258 of the housing teeth 224 and the first sides 344*a-b* of the pawl teeth 338*a-b*. For example, the engagement of two pawl teeth 338*a-b* with two consecutive housing teeth 224 as shown can provide substantially the same engagement surface area for resisting rotation in the loosening direction as a single pawl tooth and housing tooth of twice the size shown. As the size of the housing teeth 224 is reduced, the number of housing teeth 224 can increase, and the tightening resolution of the reel 204 can increase. When the knob member 218 is advanced by one housing tooth 224 in the tightening direction (shown by arrow A), the rotational distance that the knob member 218 travels is reduced as the size of the housing teeth 224 is reduced and the number of housing teeth 224 is increased. Thus, by using more, and smaller, housing teeth 224, the tightening resolution of the reel 204 is increased so that the lacing system 200 can be tightened more precisely to the desired level of tightness. Also, as the size of the housing teeth 224 is reduced, the distance that the pawls 236 are displaced in the radially inward direction when the knob member 218 is tightened is also reduced, thereby making the knob member 218 easier to rotate in the tightening direction. It is important to note that, in some embodiments, because the multiple pawl teeth 338*a-b* are used, the knob member 218 can be easily rotated in the tightening direction while strongly resisting rotation in the loosening direction. Although two pawl teeth 338*a-b* are shown per pawl 236, additional pawl teeth (e.g., three, four, five, or more) can be used, and, in some embodiments, a single pawl tooth can be used. As shown for example in FIG. 20, in some embodiments, one or more of the pawl teeth 338*a-b* and the housing teeth 224 can be configured to lock together when fully engaged, thereby preventing the pawl 236 from rotating radially inward unless the knob member 218 is moved in the tightening direction (shown by arrow A). The surface 258 of the housing tooth 224 and the surface 344*a* of the pawl tooth 338*a* can be form an angle 343 (e.g., by at least about 5° and/or by less than or equal to about 15°, or by about 10°) from a line D, which can be perpendicular to the tangent line C for the pivot axis 334 of the corresponding pawl 236. The line D can be tangent to the arc tracked by the surface 344*a* of the pawl tooth 338*a* as it pivots radially inward. Since the surface 258 of the housing tooth 224 is angled towards the pawl beam 330, the surface 334*a* can abut against the surface 258 when a force urges the surface 334*a* to move in the direction of arrow D. Thus, when the pawl tooth 338*a* fully engages the housing tooth 224 such that the surface 344*a* of the pawl tooth 338*a* abuts against the surface 258 of the housing tooth 224, the pawl 236 is prevented from rotating in the radially inward direction because radially inward rotation would cause the surface 344*a* of the pawl tooth 338*a* to press more firmly against the surface 258 of the housing tooth 224. The angled interface between the surfaces 258 and 344*a* can also provide a force on the pawl 236 in the radially outward direction when a loosening force is applied (shown by arrow B). To allow the pawl 236 to rotate radially inwardly, the pawl 236 can be shifted in the tightening direction (shown by arrow A) so that the surface 344*a* of the pawl tooth 338*a* disengages from the surface 258 of the housing tooth 224. The other pawl teeth (e.g., pawl tooth 338*b*) can operate similar to the pawl tooth 338*a* to prevent unintentional disengagement of the pawls 236.

When the knob member 218 is rotated in the tightening direction (shown by arrow A), the second sides 260 of the housing teeth 224 can slide along the second sides 346*a-b* of the pawl teeth 338*a-b*, causing the pawls 236 to rotate about the pivot axis (e.g., about the pivot tab 336) so that the pawl beams 330 are displaced radially inwardly away from the housing teeth 224, as shown in FIG. 21. As the pawls 236 rotate, the pawl springs 232 can be further flexed, for example to a position that is less curved, and the end piece 342 can slide along the wall of the pawl depression 224 that is further away from the pawl base 328. The curved edge of the generally cylindrically shaped end piece 342 can provide a small contact area between the end piece 342 and the wall of the pawl depression 224 to reduce the amount of friction therebetween as the end piece 342 slides. Once the tips of the pawl teeth 338*a-b* pass the tips of the housing teeth 224, the pawls 236 can snap radially outwardly to a position similar to that shown in FIG. 20 except that the pawls 236 are advance by one housing tooth 224, or one step, in the tightening direction. To tighten the lacing system 200, the user can rotate the knob member 218 in the tightening direction by a desired amount, with the pawls 236 snapping back after each step to prevent rotation in the loosening direction.

As can be seen in FIGS. 20 and 21, the flanges 337 of the pawls 236 can extend radially outwardly past the tips of the housing teeth 224, but the flanges 337 can be positioned near the tops of the pawls 236 where the flanges 337 do not contact the housing teeth 224. Rather, the flanges 337 can contact a portion of the wall 325 of the pawl depressions 324, as can be seen in FIG. 19. As the pawls 236 rotate, the flanges 337 can roll slightly against the wall of the pawl depressions 324 to facilitate the desired rotational displacement of the pawls 236. The mating of flange 337 and wall portion 325 can also assist in maintaining the general radial and axial position of the pawl 236 in the pawl depression 324.

The pawls 236 can be configured differently than as shown in the illustrated embodiments. For example, in some embodiments, the flexible arm of the pawl spring 332 can curve toward the pawl beam 330 (e.g., in the opposite direction as that shown in the illustrated embodiments), and a middle portion of the curved arm of the pawl spring 332 can ride along a wall of the corresponding depression 324. In some embodiments, the curved arm can be configured so that it is more curved when in the more flexed position (e.g., when the pawl beam 330 is displaced away from the housing teeth 224) than when in the less flexed position (e.g., when the pawl beam 330 is engaged with the housing teeth 224). In some embodiments, the flexible arm can be attached to the pawl 236 at locations other than that shown in the illustrated embodiment. For example, the flexible arm of the pawl spring 332 can be extend from the end of the pawl beam 330 that is furthest from the pivot tab 336. Other variations are possible. Also, in some embodiments, the pawl spring 332 can include a flexible arm that extends in generally the opposite direction as the pawl beam 330, or generally radially inwardly, or in various other suitable directions so long as the pawl spring 332 can be flexed to bias the pawl beam 330 toward the housing teeth 224. As discussed above, the pawl spring 332 can also be made from a leaf spring, or a coil spring, or any other suitable biasing member configured to bias the pawl beam 330 radially toward the housing teeth 224.

Although various embodiments discussed herein include housing teeth 224 that extend radially inwardly and pawls 236 configured to be biased radially outwardly toward the housing teeth 224, other configurations are possible. For example, the housing teeth 224 can extend radially outwardly. The housing teeth 224 can be formed, for example, on the outside surface of the shaft 244 or similar structure. In these embodiments, the pawls 236 can be configured to be biased radially inwardly toward the housing teeth 224. In some embodiments it may be advantageous to position the housing teeth 224 nearer to the periphery of the reel 204 (e.g., as shown in the illustrated embodiments) so that the housing teeth 224 are disposed along a larger circumference so that more housing teeth 224 can be included, thereby increasing the tightening resolution (the number of teeth per revolution) of the reel 204.

Figure 22:
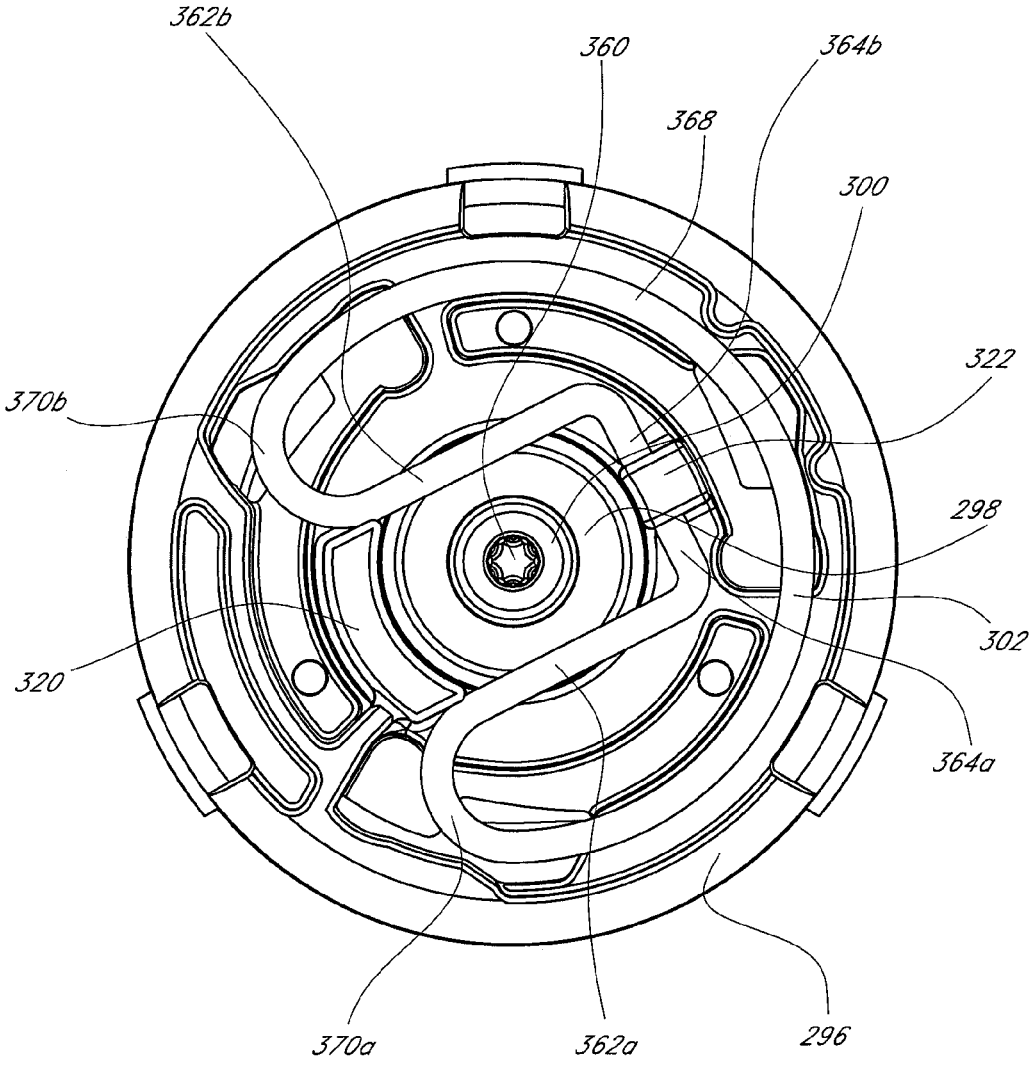
FIG. 22 is a top view of the spring bushing, fastener, and knob spring of FIG. 15 shown assembled with the knob core of FIG. 15.

FIG. 22 is a top view of the knob core 296, the spring bushing 298, the fastener 300, and the knob spring 302 in the assembled configurations. With reference now to FIGS. 15, 16, and 22, the spring bushing 298 can be generally cylindrical in shape and can have a central opening 348 formed through the center thereof. The outer surface of the spring busing 298 can be wider at a top portion 349 than at a bottom portion 351, forming a step 350 which can be configured to abut against the step 318 formed in the central opening 316 of the knob core 296 when the spring bushing 298 is fully inserted into the central opening 316 of the knob core 296. In the central opening 348 that passes through the center of the spring bushing 298, the upper portion can be wider than a lower portion, to form a step 352.

The head 354 of the fastener 300 can abut against the step 352 in the central opening of the spring bushing 298 when the fastener 300 is fully inserted into the central opening 348 of the spring bushing 298. The fastener 300 can be a screw having a shaft 356 that includes threads 358 configured to engage the threads formed in the bore 246 formed in the shaft 244 of the housing. In some embodiments, the bore 246 can include a threaded metal insert or a plastic thread molded as part of the bore 246. In some embodiments, the bore 246 does not have preformed threads, and the threads 358 of the fastener 30 can form the threads in the bore the first time that the fastener 300 is inserted into the bore 246. The head 354 can include a notch 360, which can be hexagonally or cross shaped, or otherwise configured to allow a screwdriver or other tool to turn the fastener 300. In some embodiments, the knob member 218 can be coupled to the housing 220 in some other way, such as using a snap together fastener or rivet or ultrasonic welding. Other alternatives are possible.

The knob spring 302 can include a pair of opposing engagement portions 362*a-b* which can be configured to engage the spring bushing 298. A pair of end pieces 364*a-b* can extend approximately orthogonally from the engagement portions 362*a-b* in an inward direction. An interconnecting portion 368, which can be shaped to follow the partial circumference of a circle, can be attached to the engagement portions 362*a-b* by curved connectors 370*a-b*.

The knob spring 302 can be secured to the knob core 296. The wide engagement tab 320 can be configured to fit between the curved connectors 370*a-b* of the knob spring 302, and the narrow engagement tab 322 can be configured to fit between the end pieces 364*a-b* of the knob spring 302 to prevent the knob spring 302 from rotating or otherwise moving with respect to the knob core 296. In some embodiments, the wide engagement tab 320 and/or the narrow engagement tab 322 can be configured to receive the knob spring 302 so that the knob spring 302 is maintained in a slightly flexed configuration with the curved connectors 370*a-b* bearing against the wide engagement tab 320 and/or the end pieces 364*a-b* bearing against the narrow engagement tab 322. In some embodiments, the knob spring 302 can be prevented from moving axially by the knob cover 304 when it is attached to the knob core 296.

The knob spring 302 can be configured such that the engagement portions 362*a-b* can be resiliently moved apart from one other to allow the upper wide portion 349 of the spring bushing 298 to pass between the engagement portions 362*a-b*. The spring bushing 298 can be in a disengaged position, as shown in FIG. 22, where the spring bushing 298 is located below the engagement portions 362*a-b*. In the engaged position, the upper wide portion 349 of the spring bushing 298 can be disposed above the engagement portions 362*a-b* of the knob spring 302. The upper wide portion 349 of the spring bushing can be wider than the distance between the engagement portions 362*a-b* of the knob spring 302 to prevent the spring bushing from inadvertently transitioning between the engaged and disengaged positions. To transfer the spring bushing 298 from the engaged to the disengaged positions, a force can be applied, for example by pulling the knob member 218 in the axial direction away from the base member 214, that causes the spring bushing 298 to press down against the engagement portions 362*a-b* causing the engagement portions 362*a-b* to resiliently separate from one another until the upper wide portion 359 of the spring bushing 298 passes between the engagement portions 362*a-b*. To transfer the spring bushing 298 from the disengaged to the engaged positions, a force can be applied, for example by pushing the knob member 218 in the axial direction toward the base member 214, that causes the spring bushing 298 to press up against the engagement portions 362*a-b* causing the engagement portions 362*a-b* to resiliently separate from one another until the upper wide portion 359 of the spring bushing 298 passes between the engagement portions 362*a-b*.

Many variations are possible. For example, in some embodiments, the engagement portions 362*a-b* can be maintained rigidly in place and the spring bushing 298 can be made from a resiliently compressible material so that the spring bushing 298 can transition between the engaged and disengaged positions by resiliently compressing and passing between the engagement portions 362*a-b*. In some embodiments, the fastener 300 and the spring bushing 298 can be combined into a single piece. The knob spring 302 can assume a variety of other shapes and can be attached to the knob core 296 in a variety of other manners such that the engagement portions 262*a-b* are configured to resiliently flex away from one another. The spring bushing 298 can be formed in various other shapes than that shown in the illustrated embodiments. In some embodiments, the spring bushing 298 can be rotationally asymmetrical and can rotate with the knob core 296 and knob spring 302. Thus, in some cases, the spring bushing 298 can have flat sides that engage the knob spring 302 along a line instead of just at a point.

With reference now to FIGS. 15 and 16, the knob cover 304 can be generally disc shaped. The knob cover 304 can have a domed or generally frustoconical top wall 372 and a peripheral wall 374 with a cavity 376 formed therein. A central opening 378 can be formed at the center of the top wall 372 to allow a screwdriver or other tool to be inserted therethrough to engage the notch 360 on the fastener 300. The knob cover 304 can include securing tabs 380 and notches 382 configured to engage the corresponding notches 312 and protrusions 314 on the knob core 196 to secure the knob cover 304 to the knob core 296 using a snap-fit connection. The knob cover 304 can be secured to the knob core 296 in various other ways such as using an adhesive, a threaded connection, ultrasonic welding, or any other suitable manner. The knob cover 304 can be either fixedly or removably attached to the knob core 296. When the knob cover 304 is attached to the knob core 296, the pawls 236, the spring bushing 298, the fastener 300, and the knob spring 302 can be enclosed therebetween.

Top tabs 384 can extend downward from the underside of the top wall 372 of the knob cover 304. The top tabs 384 can align with the pivot tabs 336 of the pawls 236, and the bottom surfaces of the top tabs 384 can contact, or nearly contact, the top surfaces of the pivot tabs 336 of the pawls 236 to thereby prevent the pawls from moving axially. Many variations are possible. In some embodiments, the pivot tabs 336 of the pawls 236 can fit into bores formed in the knob cover 304 to secure the pawls 236 and allow the pawls 236 to pivot about the pivot tabs 336.

A recess 386 can be formed at the center of the cavity 376, and the recess 386 can be configured to receive the upper wide portion 349 of the spring bushing 298 when the spring bushing 298 is in the engaged position.

The peripheral wall 374 of the knob cover 304 can include notches 388 configured to receive corresponding tabs 390 formed on the inside surface of the knob grip 306. The knob grip 306 can be generally doughnut shaped and can include raised portions 392 and/or depressions 394 on the outside surface to facilitate the gripping of the knob member 218. In some embodiments, the knob grip 306 can be omitted or can be divided into intermittent portions disposed about the periphery of the knob cover 304. Other variations are possible.

An opening 396 can be formed in a portion of the top wall 372 of the knob cover 304 to provide a view of some of the internal components of the reel 204 during use, or to provide an exit path for water or other foreign material to exit the reel 204. In some embodiments, the opening 396 can be omitted.

Figure 23A:
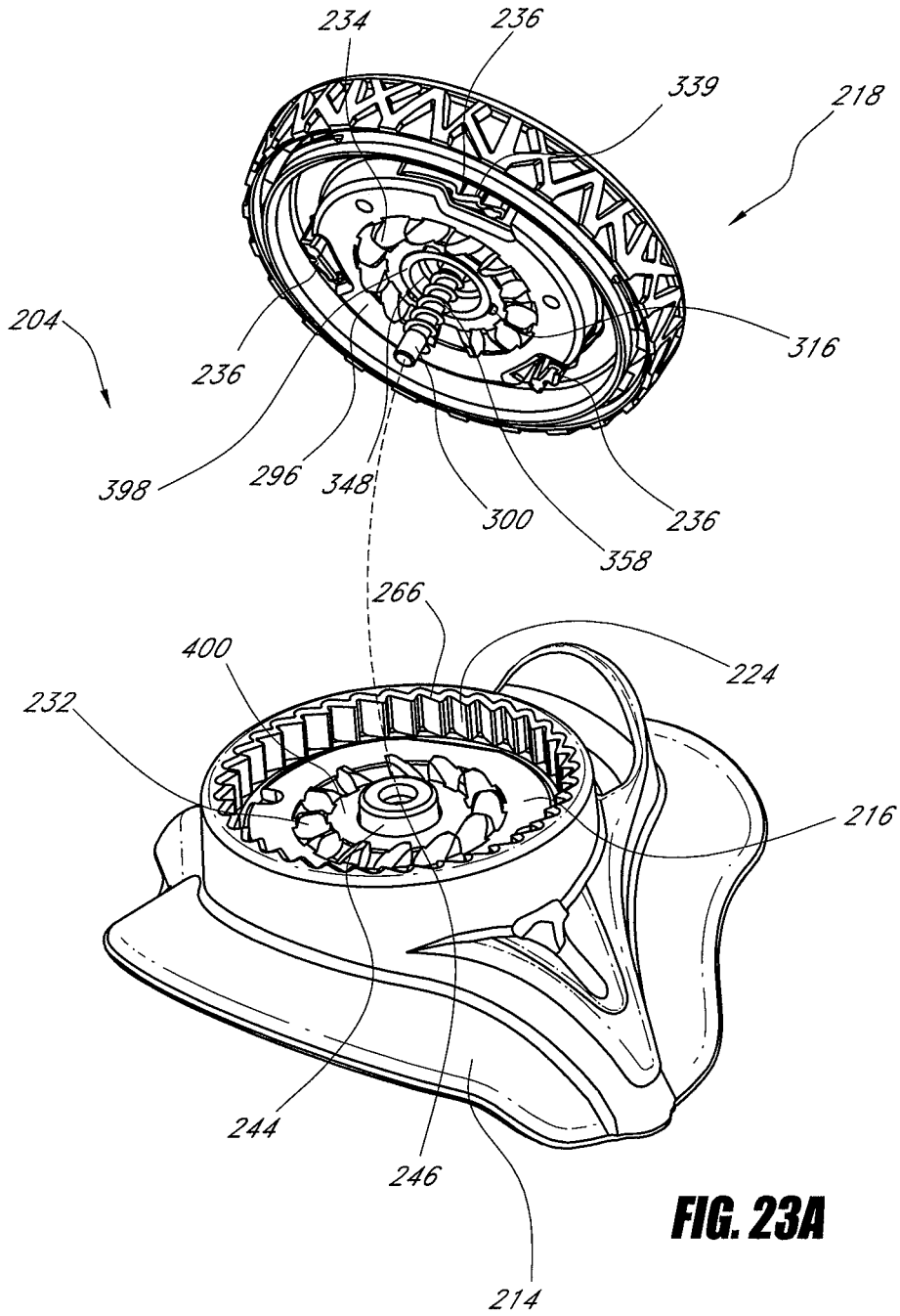
FIG. 23A is an exploded view of the reel of FIG. 4 shown in an engaged configuration.
Figure 23B:
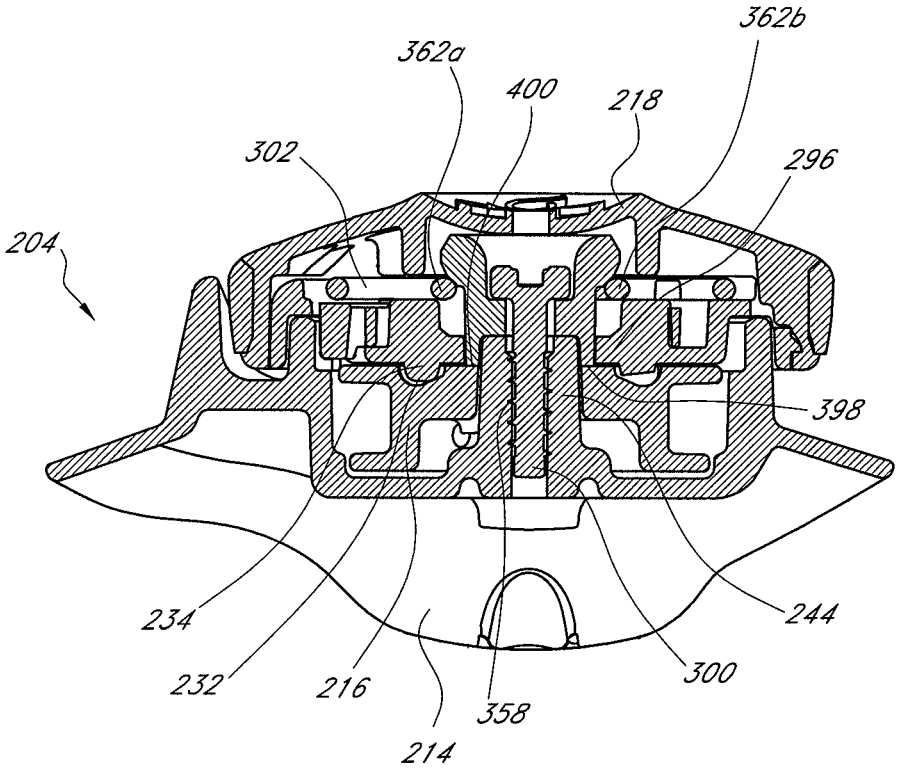
FIG. 23B is a cross sectional view of the reel of FIG. 4 shown in an engaged configuration.
Figure 24A:
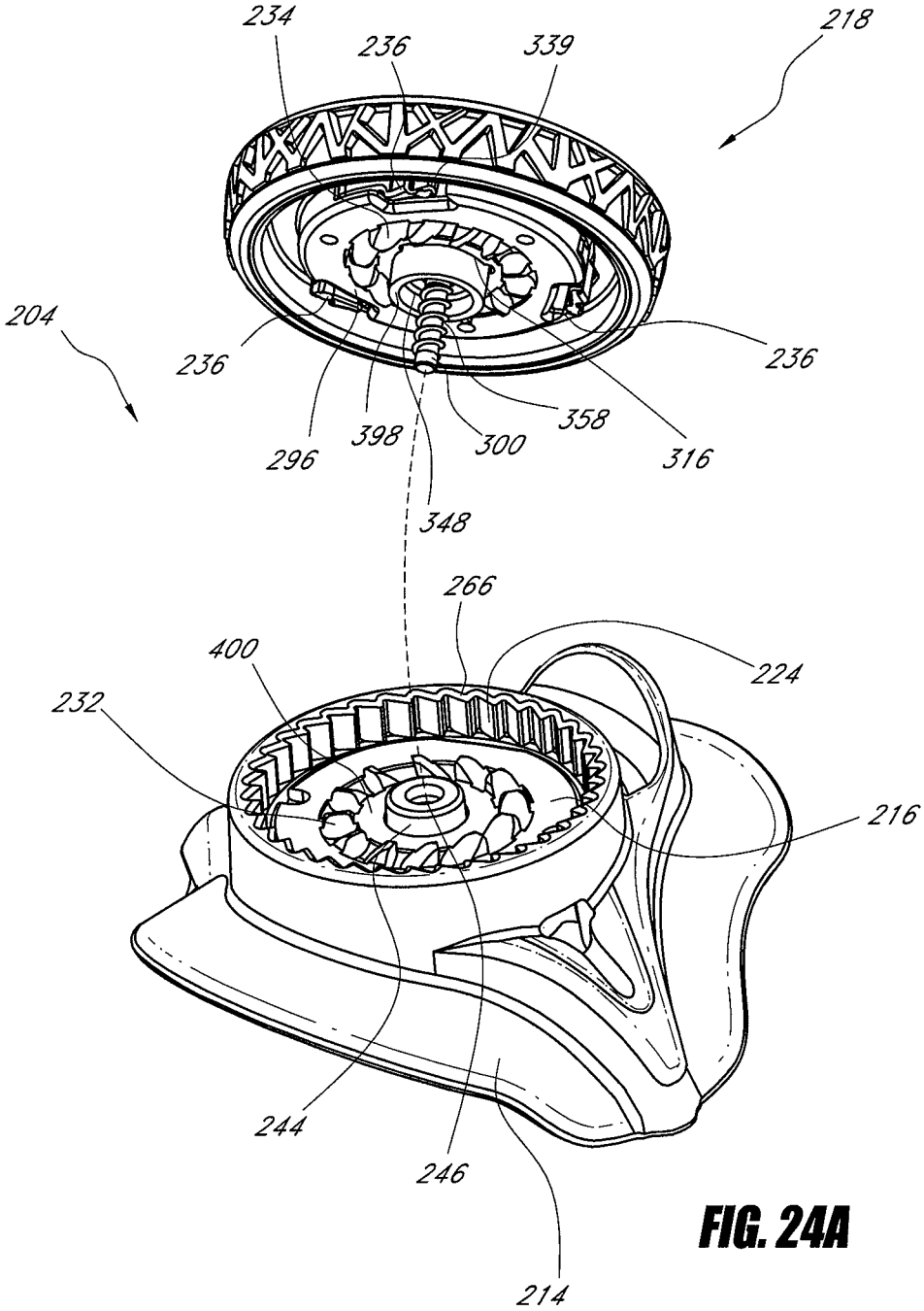
FIG. 24A is an exploded view of the reel of FIG. 4 shown in a disengaged configuration.
Figure 24B:
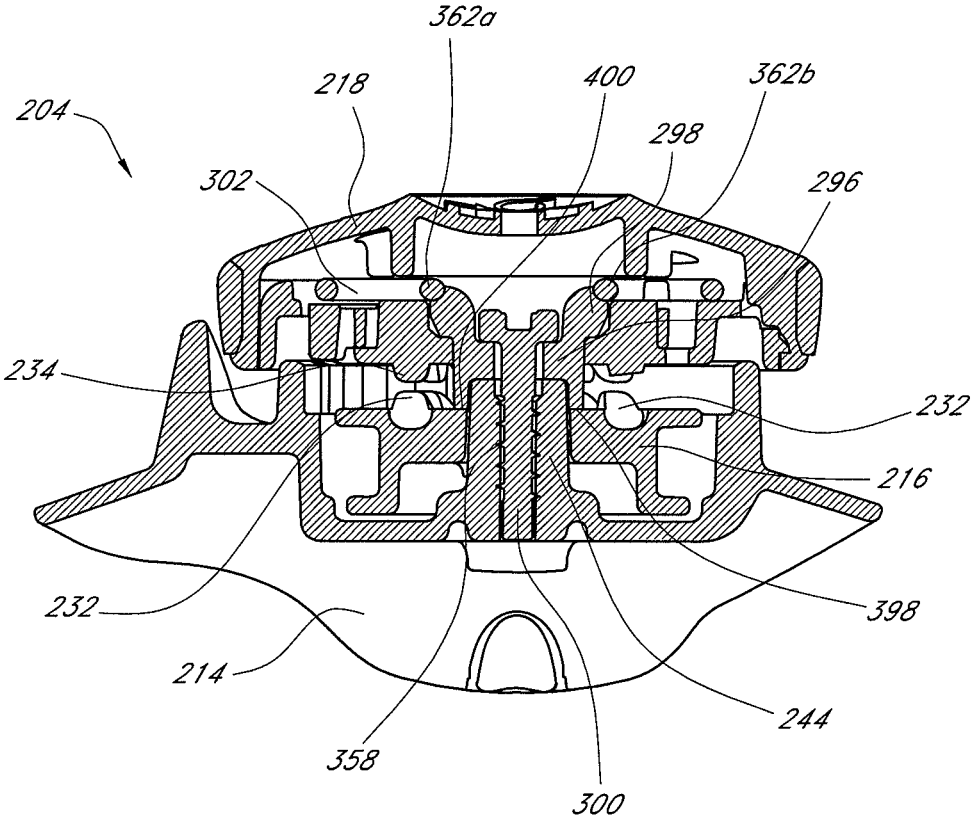
FIG. 24B is a cross sectional view of the reel of FIG. 4 shown in a disengaged configuration.

As mentioned above, the knob member 218 can be axially movable between engaged and disengaged positions. FIG. 23A is an exploded view of the reel 204 with the knob member 218 in the engaged configuration. FIG. 23B is a cross sectional view of the reel 204 with the knob member 218 in the engaged configuration. FIG. 24A is an exploded view of the reel 204 with the knob member 218 in the disengaged configuration. FIG. 24B is a cross sectional view of the reel 204 with the knob member 218 in the disengaged configuration. The knob member 218 can be secured to the base member 214 by twisting the fastener 300 so that the threads 358 mate with corresponding threads in the bore 246 formed in the shaft 244. In some embodiments, when the fastener 300 is sufficiently tightened, the portion of the shaft 244 that extends up past the spool member 216 can enter into a lower portion of the central opening 348 formed through the spring bushing 298. The bottom edge 398 of the spring bushing 298 can abut against, or nearly contact, the annular region 400 inside of the spool teeth 232.

When the knob member 218 is in the engaged position, as shown in FIGS. 23A and 23B, the spring bushing 298 and the fastener 300 can be maintained in an raised position by the knob spring 302, as discussed above, so that the bottom edge 398 of the spring bushing 298 does not extend past the central opening 316 of the knob core 296. Thus, the knob member 218 is maintained in the lower engaged position (shown in dotted lines in FIG. 5), with the bottom of the knob core 296 abutting against, or in close proximity to, the top surface of the spool member 216. Thus, when in the engaged position, the knob teeth 234 engage the spool teeth 232, and the pawls 236 engage the housing teeth 224.

When the knob member 218 is in the disengaged position, as shown in FIGS. 24A and 24B, the spring bushing 298 and the fastener 300 can be maintained in a lowered position by the knob spring 302, as discussed above, so that the bottom edge 398 of the spring bushing 298 extends past the central opening 316 of the knob core 296 by at least about 1.0 mm and/or by no more than about 3.0 mm, and in some embodiments by about 2.25 mm, although other configurations outside these ranges are also possible. Since the bottom edge 398 of the spring bushing 298 continued to abut against, or nearly contact, the annular region 400 of the spool member 216, the knob member 218 is raised away from the spool member 216 and base member 214 by an amount (e.g., about 2.25 mm) sufficient to cause the knob teeth 234 to disengage from the spool teeth 232 and/or to cause the pawls 236 to disengage from the housing teeth 224. In the embodiment shown, when the knob is in the disengaged position, the knob teeth 234 disengage from the spool teeth 232 and the pawls 236 also disengage from the housing teeth 224. Thus, in the illustrated disengaged configuration the spool member 216 can be free to rotate in the loosening direction independent of the knob member 218 to loosen the lacing system 200, and the knob member 218 can be free to rotate in both the tightening and loosening directions.

Many variations are possible. In some embodiments, when in the disengaged position, the knob teeth 234 can disengage from the spool teeth 232 while the pawls 236 continue to engage the housing teeth 224 (e.g., if the step 340 shown in FIG. 17 were made larger so that the pawl teeth 338*a-b* extended further downward). In these embodiments, the knob member 218 can be impeded from rotating in the loosening direction even when in the disengaged position, but the spool member 216 can be free to rotate in the loosening direction independent of the knob member 218 to allow the lace 206 to be withdrawn to loosen the lacing system 200. In some embodiments, when in the disengaged position, the knob teeth 234 can continue to engage the spool teeth 232 (e.g., if the knob teeth 234 and/or the spool teeth 232 were made taller than in the illustrated embodiments) while the pawls 236 can disengage from the housing teeth 224. In these embodiments, the spool member 216 continues to be coupled to the knob member 218 even when in the disengaged position, but the knob member 218 and spool member 216 are permitted to rotated together in the loosening direction to release the lace 206 from the reel 204 to loosen the lacing system 200. Other variations are also possible. For example, in some embodiments, the spool member 216 can be integrally formed with, or fixedly attached to, or removably attached to the knob member 218, and the spool teeth 232 and knob teeth 234 can be omitted.

As mentioned above, when in the disengaged position, the pawls 236 can be raised sufficiently to disengage from the housing teeth 224. In some embodiments, because the pawls are biased radially outwardly by the pawl springs 232, the pawls 236 can deflect radially outwardly so that portions of the bottom surfaces of the pawls 236 are positioned above portions of the top surfaces of the housing teeth 224. Thus in some embodiments, when the knob member 218 is transitioned back to the engaged position, the pawls 236 must be deflected radially inwardly so that they can reengage with the housing teeth 224. As also mentioned above, at least a portion of the top surfaces 266 of the housing teeth 224 can be angled or beveled and/or at least a portion of the bottom surfaces 339 of the pawls 236 can be angled or beveled, so that the downward pressure applied when the knob member is returned to the engaged position can cause the pawls 236 to deflect radially inwardly to facilitate the reengagement of the pawls 236 with the housing teeth 224. In some embodiments, the pawl depressions 324 or other portions of the knob member 218, can be configured to prevent the pawls 236 from deflecting radially outwardly past the radial position where the pawls 236 engage the housing teeth 224, thereby reducing or eliminating the need to deflect the pawls 236 inwardly when transitioning the knob member 218 to the engaged position.

The knob member 218 can be transitioned from the engaged position to the disengaged position by pulling the knob member 218 axially away from the base member 214 with enough force to cause the spring bushing 298 to displace the knob spring 302 and pass therethrough. To transition the knob member 218 from the disengaged position to the engaged position the knob member 218 can be pushed in the axial direction toward the base member 214 with enough force to cause the spring bushing 298 to displace the knob spring 302 and pass therethrough.

The radial engagement of the pawls 236 with the housing teeth 224 can reduce or eliminate the occurrence of unintentionally transitioning the knob member 218 from the engaged to disengaged positions by applying force to tend to twist the knob member 218 in the loosening direction. If the lace 206 is pulled, it can impart a force tending to twist the spool member 216 in the loosening direction, and the force can be transferred to the knob 218 via the spool teeth 232 and knob teeth 234, and the pawls 236 can distributed the force radially among a certain number of the housing teeth 224. Because the pawls 236 engage the housing teeth radially, not axially, and because the pawls 236 are configured to be displaced radially (when tightening the reel 204), substantially none of the force is applied to the knob 218 in the axial direction. Thus, the radial pawls 236 do not impart any substantial force in the direction of the axial direction that would tend to separate the spool teeth 232 from the knob teeth 234 which can lead to unintentional disengagement of the knob member 218 and/or unintentional loosening of the spool member 216. Thus, the reel 204 can be configured to withstand greater amounts of force applied to pull on the lace 206 or applied to try and twist the knob member 218 in the loosening direction without unintentionally causing the knob member 218 to disengage than a reel 204 in which the pawls axially engage the housing teeth and the pawls are configured to displace axially during tightening.

Also, in some embodiments, the force applied to the pawls 236 when the knob 218 is twisted in the loosening direction is born by the pawl beams 330 such that substantially none of the force is transferred to the pawl springs 332. Thus, the pawl springs 332 can be configured to be easily flexible while the pawl beams 330 can be configured to be substantially rigid. Therefore, the pawls 236 can be configured to resist a relatively large amount of force applied to twist the knob member 218 in the loosening direction because that force is born by the rigid pawl beams 330, while the pawls can also be configured to rotate radially when a relatively small force is applied to twist the knob member 218 in the tightening direction because that force is transferred to the flexible pawl springs 332.

The components of the lacing systems described herein can be formed from any suitable material such as, but not limited to, plastic, carbon or other fiber reinforced plastic, aluminum, steel, rubber, or any other suitable material or combination of such materials. In some embodiments, the base member 214, spool member 216, knob core 296, pawls 236, spring bushing 298, knob cover 304, lace guides, or any other suitable components described herein can be injection molded or otherwise formed from any suitable polymeric material, such as nylon, PVC or PET. Some of the components described herein can be formed from a lubricious plastic such as PTFE, or other material useful in reducing the friction between a lace and such components as desired. Additionally, some of the components described herein can be coated or layered with a lubricious material to reduce the friction with interacting components or parts. The fastener 300, and the knob spring 302 can be made from a metal (e.g., aluminum or steel), but other materials can also be used such as plastics. The knob grip 306 can be formed from rubber, or latex, or silicon, or any other material to facilitate the gripping of the knob member 218.

Figure 25:
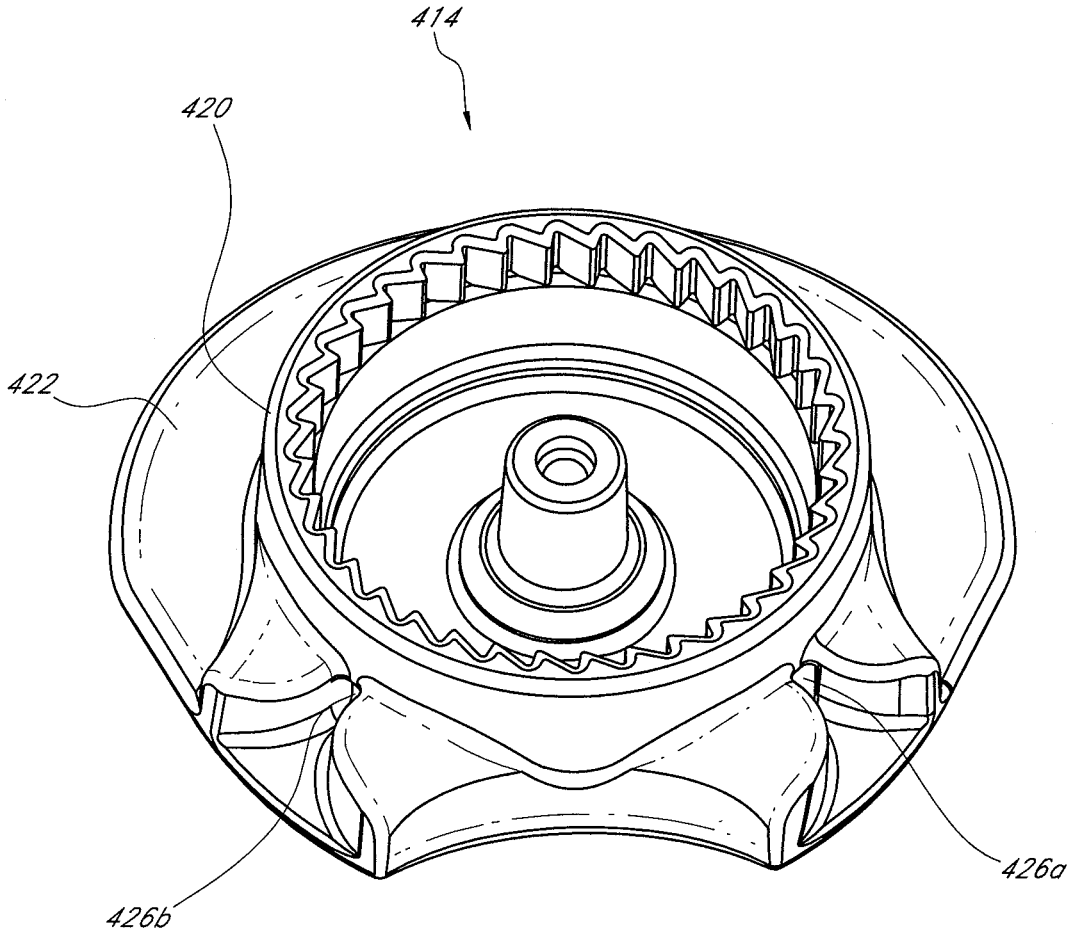
FIG. 25 is a perspective view of an alternative embodiment of a base member that can be used in place of the base member of FIG. 4.

FIG. 25 is a perspective view of an alternative embodiment of a base member 414 which can be used in place of the base member 214 discussed above. The base member 414 can include a housing 420 and a mounting flange 422 and can be generally similar to the base member 214 described above, except that the lace holes 426*a-b* can be configured to direct the lace generally radially away from the base member 414 rather than axially away from the base member 214 as shown, for example, in FIG. 2. Also, the lace holes 426*a-b* are placed generally on the same side of the base member 414, rather than on opposite ends as in the base member 214 discussed above. Many variations are possible depending on the particular application to which the lacing system is applied. For example, in some embodiments, the base member can include only one lace hole and only one end of the lace can enter the housing and attach to the spool member. In these embodiments, the other end of the lace can attach to the base member or to the article being tightened.

Figure 26:
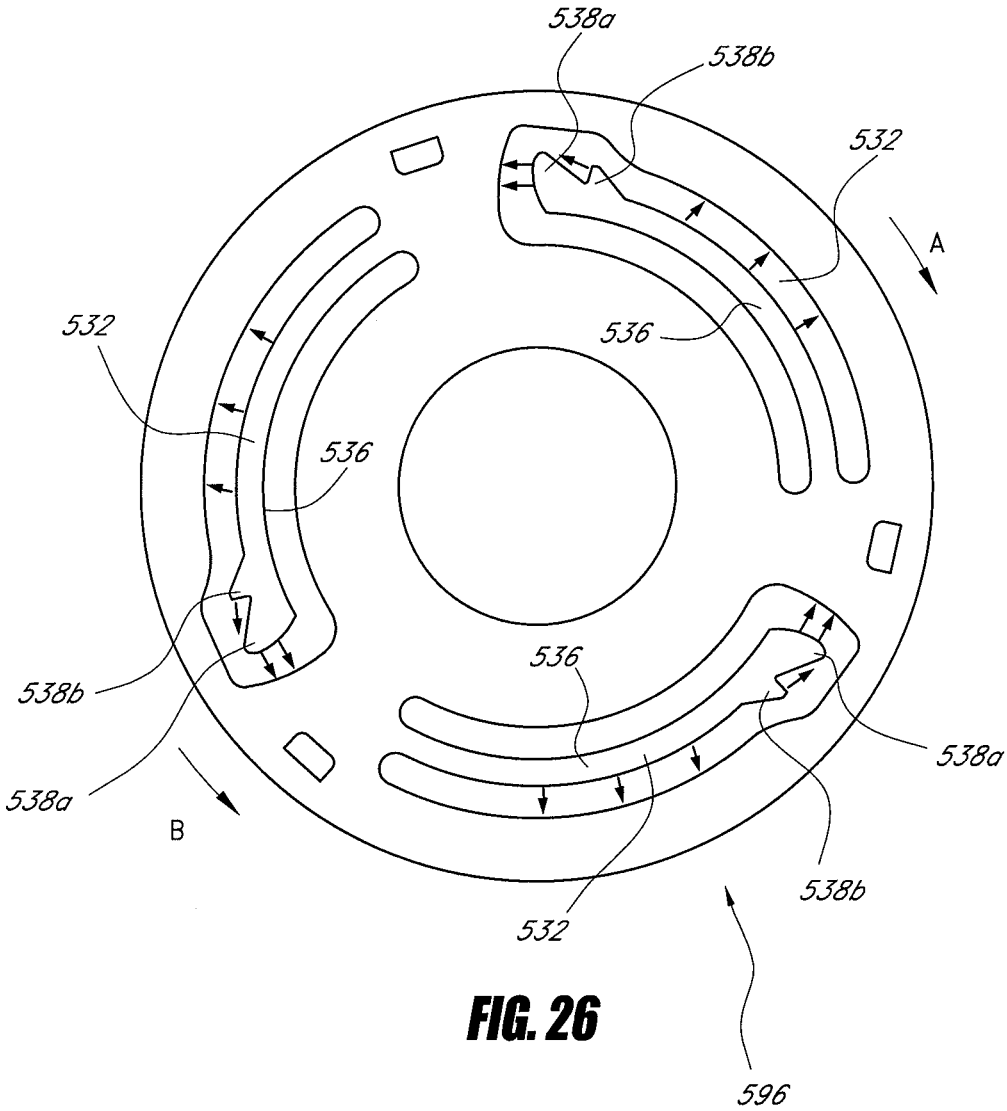
FIG. 26 is a cross sectional view of an alternative embodiment of a knob core.

FIG. 26 is a cross sectional view of another embodiment of a knob core 596 which can be used in a reel that can be similar in many ways to the reel 204 described herein. The knob core 596 can include pawls 536 which can be integrally formed with the knob core 596 to simplify construction and assembly of the reel. In other embodiments, the pawls 536 can be attached to the knob core 596 in any suitable manner. The pawls 536 can include pawl arms 532 which can be made of a material, thickness, and length so as to be flexible to allow the pawls 536 to be displaced radially inwardly by housing teeth as the knob core 596 is rotated in the tightening direction (shown by arrow A) in a manner similar to that described above. The pawls 536 can include pawl teeth 538*a-b* formed at the ends of the pawl arms 532. In the illustrated embodiment two pawl teeth 538*a-b* are used per pawl 536, but any other suitable number of pawl teeth 538*a-b* can be used.

When the knob core 596 is twisted in the loosening direction (shown by arrow B), the pawl teeth 538*a-b* can bear against housing teeth (not shown in FIG. 26) to prevent the knob core 596 from rotating in the loosening direction. The force arrows drawn in FIG. 26 illustrate the directions in which the force is distributed radially. As the pawl teeth 538*a-b* bear against the housing teeth, a force is applied from the pawl teeth 538*a-b* to the housing teeth as shown. The pawl arms 532 can be curved as shown so that, when the pawl teeth 538*a-b* bear against the housing teeth, the pawl arms 532 tend to flex or buckle radially outwardly as shown by arrows in FIG. 26. The pawls 536 can be configured such that the housing teeth abut against the pawl arms 532 such that, as the pawl arms 532 attempt to flex or buckle radially outwardly, they bear against the tips of the housing teeth, distribute the force radially to the housing teeth, and are prevented from buckling. In some embodiments, the housing teeth can substantially prevented the pawl arms 532 from moving radially outwardly. Because pawls 536 engage the housing teeth radially, not axially, and because the pawls 536 are configured to be displaced radially, not axially, during tightening, substantially none of the force applied when twisting in the loosening direction is applied axially thereby reducing or eliminating the occurrence of unintentional axial movement of the knob core 596 from the engaged position to the disengage position.

Although various embodiments of lacing systems are described herein, the various components, features, or other aspects of the embodiments of the lacing systems described herein can be combined or interchanged to form additional embodiments of lacing systems not explicitly described herein, all of which are contemplated as being a part of the present disclosure. In addition, while a number of variations have been shown and described in detail, other modifications, which are within the scope of the this disclosure, will be readily apparent to those of skill in the art based upon this disclosure. Thus, it is intended that the scope of the disclosure should not be limited by the particular disclosed embodiments described above.

What is claimed is:

1. A reel for use in a lacing system, the reel comprising:

a housing comprising a plurality of housing teeth;

a spool supported by the housing, wherein the spool is rotatable with respect to the housing, the spool comprising a channel formed therein, the channel configured to collect a lace therein to tighten the lacing system as the spool is rotated in a tightening direction and to release lace therefrom to loosen the lacing system as the spool is rotated in a loosening direction; and a knob supported by the housing, wherein the knob is rotatable with respect to the housing, the knob being coupled to the spool such that rotation of the knob causes the spool to also rotate;

wherein the knob comprises one or more pawls, and at least one of the one or more pawls comprises a pawl beam and a pawl spring integrally formed with the pawl beam, wherein the pawl beam and the pawl spring extend from a pawl base in the same general direction and the pawl spring is curved away from the pawl beam, wherein the pawl beam is movable between a first position and a second position and the pawl spring is configured to bias the pawl beam toward the first position, wherein the pawl beam comprises one or more pawl teeth configured to engage the housing teeth when the pawl beam is in the first position to prevent the knob from rotating in the loosening direction when a loosening force is applied to the knob, and wherein the one or more pawl teeth are displaced away from the housing teeth to the second position when the knob is twisted in the tightening direction to allow the knob and spool to rotate in the tightening direction.

2. The reel of claim 1, wherein the pawl spring comprises a flexible arm configured to assume a more flexed configuration as the pawl beam is displaced toward the second position, thereby biasing the pawl beam toward the first position.

3. The reel of claim 2, wherein the flexible arm comprises an end portion configured to press against a portion of the reel, and wherein the end of the flexible arm slides along the portion of the reel as the flexible arm assumes the more flexed configuration.

4. The reel of claim 3, wherein the flexible arm becomes less curved as it assumes the more flexed configuration.

5. The reel of claim 2, wherein the pawl beam is configured to rotate about a pivot axis between the first position and the second position, and wherein the flexible arm extends from a location near the pivot axis in the same general direction as the pawl beam, wherein the flexible arm extends further than the pawl beam, and wherein the flexible arm is curved away from the pawl beam.

6. The reel of claim 1, wherein the knob includes one or more pawl depressions configured to receive the one or more pawls, and the wherein the pawl spring of the at least one pawl is configured to bear against a wall of the corresponding pawl depression to bias the pawl toward the first position.

7. The reel of claim 1, wherein the housing teeth extend in a radial direction, wherein the pawl beam is radially movable between the first position and the second position, and wherein the knob is axially movable between an engaged position and a disengaged position, and wherein, when the knob is in the disengaged position, the spool is permitted to rotate in the loosening direction.

8. The reel of claim 7, wherein, when the knob is in the disengaged position, the one or more pawls are disengaged from the housing teeth so that the knob and spool are free to rotate in the loosening direction.

9. The reel of claim 7, wherein the spool comprises spool teeth, wherein the knob comprises knob teeth configured to engage the spool teeth when the knob is in the engaged position such that the knob and spool rotate together, and wherein, when the knob is in the disengaged position, the knob teeth are disengaged from the spool teeth so that the spool is free to rotate in the loosening direction.

10. The reel of claim 7, wherein, when the knob is in the disengaged position, the one or more pawls are disengaged from the housing teeth so that the knob is free to rotate in the loosening direction, and the one or more pawls are displaced in a radial direction so that a portion of the one or more pawls extends radially past the housing teeth.

11. The reel of claim 10, wherein the housing teeth comprise angled top portions to facilitate the reengagement of the one or more pawls with the housing teeth as the knob is moved to the engaged position.

12. The reel of claim 1, wherein the at least one pawl comprises at least two pawl teeth configured to simultaneously engage at least two corresponding housing teeth such that the loosening force is distributed across multiple teeth to prevent the knob from rotating in the loosening direction.

13. The reel of claim 1, wherein at least one of the one or more pawl teeth comprises a first side angled such that, when the knob is rotated in the tightening direction, a first side of a housing tooth slides along the first side of the pawl tooth such that the pawl tooth is displaced away from the housing tooth toward the second position until the housing tooth passes the first side of the pawl tooth allowing the pawl tooth to return to the first position, the pawl tooth having a second side angled such that, when a loosening force is applied to the knob, the second side of the pawl tooth bears against a second side of the housing tooth to prevent the knob from rotating in the loosening direction.

14. The reel of claim 1, wherein the pawl beam is configured to be urged toward the housing teeth when a loosening force is applied to the knob.

15. The reel of claim 14, wherein the pawl beam is configured to rotate radially about a pivot axis, and wherein one or more of the pawl teeth engages the housing teeth at a location that is radially outward from a tangent line extending from the pivot axis.

16. The reel of claim 14, wherein at least one of the pawl teeth comprises a surface configured to press against a surface of the housing teeth when a loosening force is applied to the knob such that the pawl beam is urged towards the housing teeth when a loosening force is applied, and wherein the pawl beam is prevented from moving to the second position unless the knob is rotated in the tightening direction to disengage the surface of the at least one pawl tooth from the surface of the housing tooth.

17. The reel of claim 14, wherein a side of the pawl beam is configured to abut against one or more tips of housing teeth that are not engaged by the one or more pawl teeth when a loosening force is applied to the knob and the pawl beam is urged toward the housing teeth.

18. The reel of claim 1, wherein the pawl base is not radially movable with respect to the knob.

19. The reel of claim 18, wherein the pawl base comprises a pivot tab that fits into a bore in the knob such that the pawl base does not move radially with respect to the knob.

20. The reel of claim 1, wherein the pawl spring extends further than the pawl beam.

21. The reel of claim 1, wherein the knob comprises a knob cover configured to be manipulated by a user, and wherein the one or more pawls are separately formed from the knob cover and are coupled to the knob cover.

22. The reel of claim 1, wherein the knob comprises two or more pawls and wherein the two or more pawls are separately formed from each other.

23. The reel of claim 1, wherein the knob comprises knob teeth that extend axially downwardly, where the spool comprises spool teeth that extend axially upwardly, and wherein the knob teeth are configured to engage the spool teeth to couple the knob to the spool such that rotation of the knob causes the spool to also rotate.

24. A method of making a reel for use in a lacing system, the method comprising:

providing a housing, the housing comprising a plurality of housing teeth;

placing a spool within the housing such that the spool is rotatable with respect to the housing, the spool comprising a channel formed therein, the channel configured to collect a lace therein to tighten the lacing system as the spool is rotated in a tightening direction and to release lace therefrom to loosen the lacing system as the spool is rotated in a loosening direction; and attaching a knob to the housing such that the knob is rotatable with respect to the housing and such that the knob is coupled to the spool so that rotation of the knob causes the spool to also rotate;

wherein the knob comprises one or more pawls, and at least one of the one or more pawls comprises a pawl beam and a pawl spring, wherein the pawl beam and pawl spring are integrally formed, wherein the pawl beam and the pawl spring extend from a pawl base in the same general direction and the pawl spring is curved away from the pawl beam, wherein the pawl beam is movable between a first position and a second position and the pawl spring is configured to bias the pawl beam toward the first position, wherein the pawl beam comprises one or more pawl teeth configured to engage the housing teeth when the pawl beam is in the first position to prevent the knob from rotating in the a loosening direction when a loosening force is applied to twist the knob in the loosening direction, and wherein the one or more pawl teeth are displaced away from the housing teeth to the second position when the knob is twisted in the tightening direction to allow the knob and spool to rotate in the tightening direction.

25. The method of claim 24, wherein the pawl beam is radially movable between the first position and the second position.

26. The method of claim 25, wherein the knob is axially movable between an engaged position and a disengaged position, and wherein, when the knob is in the disengaged position, the spool is permitted to rotate in the loosening direction.

27. The method of claim 24, wherein the pawl spring comprises a first end attached to the pawl base and a second end that is detached from the rest of the knob.

28. A pawl for use with a reel in a lacing system, the pawl comprising:

a pawl beam having one or more pawl teeth configured to interface with housing teeth on a housing of the reel, the pawl beam being movable between a first position and a second position; and a pawl spring integrally formed with the pawl beam, the pawl spring configured to bias the pawl beam toward the first position;

wherein the pawl beam and the pawl spring extend from a pawl base in the same general direction and the pawl spring is curbed away from the pawl beam, wherein the one or more pawl teeth are configured to engage the housing teeth when the pawl beam is in the first position to prevent the pawl from moving in a loosening direction when a loosening force is applied to pawl, and wherein the one or more pawl teeth are configured to disengage from the housing teeth when the pawl beam is in the second position to allow the pawls to move in a tightening direction.

29. The pawl of claim 28, wherein the pawl spring extends further than the pawl beam.

30. The pawl of claim 28, wherein the pawl base is configured to rotate about a pivot axis to move the pawl beam between the first position and the second position.

31. The pawl of claim 28, wherein the pawl beam comprises at least two pawl teeth configured to simultaneously engage at least two corresponding housing teeth such that the loosening force is distributed across multiple teeth to prevent the pawl from moving in the loosening direction.

32. A reel for use in a lacing system, the reel comprising:

a housing comprising a plurality of housing teeth;

a spool supported by the housing, wherein the spool is rotatable with respect to the housing, the spool comprising a channel formed therein, the channel configured to collect a lace therein to tighten the lacing system as the spool is rotated in a tightening direction and to release lace therefrom to loosen the lacing system as the spool is rotated in a loosening direction; and a knob supported by the housing, wherein the knob is rotatable with respect to the housing, the knob being coupled to the spool such that rotation of the knob causes the spool to also rotate;

wherein the knob comprises one or more pawls configured to interface with the housing teeth, wherein at least one of the one or more pawls comprises a flexible pawl arm attached to the knob at a first end and having one or more pawl teeth formed on a second end, wherein the pawl arm is configured to flex in a first direction as the knob is rotated in the tightening direction such that the one or more pawl teeth are displaced away from the housing teeth to allow the knob to rotate in the tightening direction, wherein the pawl arm is configured such that when a loosening force is applied to twist the knob in the loosening direction, the one or more pawl teeth engage the corresponding housing teeth to prevent the knob from rotating in the loosening direction, and the loosening force causes the flexible pawl arm to flex in a second direction toward the housing teeth such that the flexible pawl arm abuts against the housing teeth to prevent the flexible pawl arm from buckling under the loosening force.

33. The reel of claim 32, wherein the at least one pawl arm is integrally formed with the knob.

34. The reel of claim 32, wherein the housing teeth extend radially inwardly, and the pawl arm is configured to flex radially outwardly as the knob is twisted in the loosening direction such that the pawl arm abuts against the housing teeth, and wherein the knob is movable between an engaged position and a disengaged position, wherein when the knob is in the disengaged position, the spool is permitted to rotate in the loosening direction.

* * * * *